US006595446B1

(12) United States Patent
Kamoshida et al.

(10) Patent No.: US 6,595,446 B1
(45) Date of Patent: Jul. 22, 2003

(54) SOIL MODIFYING MACHINE

(75) Inventors: Yasuhiro Kamoshida, Yokosuka (JP); Yasuhiro Yoshida, Kawasaki (JP)

(73) Assignee: Komatsu, Ltd., Tokyo (JP)

( * ) Notice: Subject to any disclaimer, the term of this patent is extended or adjusted under 35 U.S.C. 154(b) by 380 days.

(21) Appl. No.: 09/665,597

(22) Filed: Sep. 19, 2000

(30) Foreign Application Priority Data

Sep. 27, 1999 (JP) ..... 11-272960

(51) Int. Cl.[7] ..... B02C 21/02

(52) U.S. Cl. ..... 241/101.2; 241/101.74; 241/152.2

(58) Field of Search ..... 241/34, 101.2, 241/101.74, 152.2, 194

(56) References Cited

U.S. PATENT DOCUMENTS 3,937,261 A * 2/1976 Blum ..... 241/101.74
5,722,607 A * 3/1998 Hellmich ..... 241/189.1
5,988,937 A * 11/1999 Komoriya et al. ..... 404/90
6,000,641 A * 12/1999 Komoriya et al. ..... 241/29

FOREIGN PATENT DOCUMENTS

JP 57-048043 3/1982
JP 2000-27227 1/2000
JP 2000-170157 6/2000
WO WO97/25486 7/1997

* cited by examiner

*Primary Examiner*—John M. Husar
(74) *Attorney, Agent, or Firm*—Armstrong, Westerman & Hattori, LLP

(57) ABSTRACT

A soil modifying machine comprises a machine body, a hopper through which a soil to be modified is fed to the machine body, a soil conveying means for conveying the soil supplied through the hopper, a soil conditioner supply device for supplying a soil conditioner to the soil, a mixing unit disposed at a discharge portion of the soil conveying means, the mixing unit comprising an outer case, a soil cutter device disposed inside the case and a plurality of impact hammers disposed below the soil cutter device, and a modified soil conveyer disposed at a discharge portion of said mixer unit. The soil cutter device may comprise a cylindrical drum, a plurality of cutters mounted to an outer peripheral surface of the drum, and a motor for driving and rotating the drum. Each of the impact hammers may comprise a rotational shaft, a plurality of hammer pieces, each in shape of plate, mounted to the rotational shaft and a motor for driving and rotating the impact hammer. A rear side mixer may be further disposed downstream the modified soil discharge portion.

3 Claims, 28 Drawing Sheets

SOIL MODIFYING MACHINE

BACKGROUND OF THE INVENTION

The present invention relates to a soil modifying machine for modifying or improving soil in a state of clay which is obtained by condensation and dewatering of muddy water generated at a crushing field, a shield-type tunnel excavating field or the like, such a modified soil being thereafter recycled as backfill (soil to be refilled) or roadbed material.

Further, it is first to be noted that although the term "modify (modification or modified)" used herein may be substituted with "improve" or "ameliorate", the meaning thereof is to modify (improve or ameliorate) nature, form quality or the like of a soil.

For example, Japanese Patent Laid-open (KOKAI) Publication No. HEI 11-169739 proposes such a soil modifying machine.

This soil modifying machine generally comprises, as shown in FIG. 33, a machine body, not shown, a mixer 1, a modified soil conveyer 2, a soil conveyer 3, a soil conditioner supply device 4 and a soil hopper 5. In a such soil modifying machine, a soil to be modified 6, e.g., raw soil in the soil hopper 5 is conveyed to the mixer 1 through the material soil conveyer 3 and a soil conditioner is supplied from the soil conditioner supply device 4 to the soil 6 on the way of being conveyed by the soil conveyer 3. Thereafter, the soil 6 and the soil conditioner is supplied to the mixer 1 so as to be crushed and mixed, and the thus modified soil 7 is discharged out of the machine body by means of the modified soil conveyer 2.

In such a soil modifying machine, the mixer 1 has an outer case (or housing) 10 in which a soil cutter cutting) device 11 as a primary mixer and a plurality of impact hammers (rotors having rotators) 12 are disposed so that the soil 6 conveyed by the soil conveyer 3 is cut off and dropped down by the soil cutter device 11 towards the impact hammers 12, and such soil and soil conditioner are crushed and then mixed by the impact hammers 12, thus performing the soil modification. The modified soil 7 is dropped down on the modified soil conveyer 2 through a discharge port 8.

Incidentally, in the soil crushing field or site, raw stones which are collected from a mountain or the like, are crushed by a crusher, and mud component or like adhering or sticking to the crushed stones are washed and removed so that the crushed stones can be utilized as aggregate.

The mud component removed in the above process is in a state of muddy water, which is then condensed and dewatered by a dehydrating (dewatering) press into a soil in the form of clay called as dewatered cake, which is then treated. When the dewatered cake is dried, fine particles scatter from its surface, and when the dewatered cake is wetted by rain water or like, it returns to the original muddy state.

As mentioned above, the dewatered cake has a low strength, and hence, in a case where such dewatered cake is recycled as backfill or roadbed material, the fine particles thereof will be scattered on sunny days or will be wet and flowed on rainy days, thus being inconvenient. Accordingly, it is difficult to recycle the dewatered cake as the backfill or roadbed material, and hence, such dewatered cake is left as it is in the raw stone crushing filed or site in a mountain.

The inventors of the subject application have tried to modify the soil condition by using a conventional soil modifying machine for recycling the dewatered cake as backfill or roadbed material, it was impossible to modify the soil condition to an extent suitable for recycling the dewatered cake as the backfill or roadbed material until the dewatered cake is very finely crushed and mixed with a solidifying agent because the dewatered cake has a low strength and is composed of a fine particle soil.

Through the research and experiment of the inventors, thereafter, the following matters were found out.

The soil cutter device 11 of the mixer 1 described above has a structure, as shown in FIG. 34A, that a plurality of cutters 14, each having a long scale, are mounted around a rotational shaft 13 so as to extend radially and to form widened V-shaped spaces 15 between the adjacent cutters 14 and the rotational shaft 13, respectively. When the rotational shaft 13 is rotated, the cutters 14 are also rotated to thereby cut off the soil 6 conveyed through the soil conveyer 3.

During the above cutting operation, when lump of clay 16 which cannot be cut by the cutter 14 exists in the soil 6, as shown in FIG. 34A, the cutter 14 which collides with the clay lump 16, is rotated while pushing the clay lump 16 into the material soil 6 as shown in FIGS. 34B and 34C and passes the clay lump 16 without cutting it. Thereafter, as shown in FIG. 34D, the next cutter 14 digs out the clay lump 16 and sputter it in a direction of the preceding cutter 14 into the V-shaped space 15 between this cutter 14 and the preceding cutter 14. When the cutter 14 is further rotated, the clay lump 16 between the space 15 drops down towards the impact hammers 12 as shown in FIG. 33.

As mentioned hereinbefore, when the soil cutter device 11 of the conventional structure is utilized, the lump of clay 16 which cannot be cut off by the cutter may fall downward as it is towards the impact hammers 12, there increases a possibility of the clay lump having a large diameter being mixed with the cut soil 6.

The clay lump having a large particle (soil) diameter has a worse infiltration of the soil conditioner. That is, in such a clay lump, even if the soil conditioner adheres to the outer surface of the clay lump, the soil conditioner hardly infiltrates thereinto, and hence, the inside central portion of the clay lump will maintain its clay state. As a result, in a case where the clay lump having a large diameter is mixed with the raw soil at a large mixing ratio, the soil conditioner cannot be sufficiently mixed with the soil, and hence, the modified soil which can be recycled as the backfill or roadbed material will not be obtainable.

Furthermore, in the conventional structure, the impact hammer 12 comprises a central rotational shaft 17 and four hammer pieces (blades) 18 mounted thereon so as to extend radially, each hammer pieces 18 being a forged product in a fist-like shape. Because of such a structure, the hammer piece 18 has a not so-large beating surface for giving an impact to the materials to be mixed (soil to be modified and soil conditioner), and moreover, since the beating surface is curved, the materials will not be fully crushed by the impact, and the dewatered cake will not be made fine, thus maintaining a large percentage of existing clay lump having a large diameter to be mixed.

Accordingly, in this case, as like as the aforementioned case, the soil conditioner cannot be sufficiently mixed with the soil to be modified, and hence, the modified soil which can be recycled as the backfill or roadbed material will not be obtainable.

SUMMARY OF THE INVENTION

An object of the present invention is to substantially eliminate defects or drawbacks encountered in the prior art mentioned above and to provide a soil modifying machine for obtaining a modified soil which can be recycled as backfill or roadbed material by mixing soil in the form of clay such as dewatered cake and a soil conditioner.

The inventors of the subject application have searched and experienced in view of the prior art mentioned above and found out that the soil could be finely granulated by improving a shape of a soil cutter device of a mixer to be a modified soil which can be recycled as backfill or roadbed material.

Further, the inventors have found out that the soil could be finely granulated by improving a shape of an impact hammer of a mixer to be a modified soil which can be recycled as backfill or roadbed material.

Furthermore, the inventors have also found out that the once modified soil can be further finely granulated by again mixing it by another mixer disposed downstream side of the first mentioned mixer to thereby be a modified soil which can be effectively recycled as backfill or roadbed material.

The above and other objects can hence be achieved according to the present invention by providing, in one aspect, a soil modifying machine having a machine body to which are disposed a soil hopper, a material soil conveyer for conveying a soil to be modified from the soil hopper, a soil conditioner supply device for supplying a soil conditioner to the soil and a mixer for crushing and mixing the conveyed soil and the soil conditioner to obtain a modified soil, the soil modifying machine being characterized in that the mixer is provided with a soil cutter device and a impact hammer and the soil cutter device comprises a drum and a cutter mounted to an outer peripheral surface of the drum.

According to this structure, at the time when the drum is rotated and the soil conveyed by the soil conveyer is cut off by the cutter and then supplied to the impact hammer, the soil lump having a particle diameter larger than the distance between the outer peripheral surface of the drum and the conveying surface of the soil conveyer cannot be supplied to the impact hammer.

Accordingly, even in the case where the soil lump having a large particle diameter is contained in the material soil, the material soil can be finely granulated to be a modified soil and the soil conditioner can fully infiltrate into the soil, thus improving the soil modifying ability. Thus, the soil in the shape of clay can be recycled as backfill or roadbed material.

In the above aspect the cutter has a height projecting from the outer peripheral surface of the drum by a length substantially equal to or less than a target particle diameter of the soil to be modified and a minimum distance between the outer peripheral surface of the drum and a conveying surface of the material soil conveyer is substantially equal to the target particle diameter.

According to this structure, since the soil having a particle diameter substantially the same as the target particle diameter of the soil to be modified can be supplied to the impact hammer, the modified soil having a predetermined target particle diameter can be obtained, and hence, the desired modifying effects can be achieved.

Furthermore, the cutter is disposed obliquely with respect to a direction parallel to an axis of the drum.

According to this structure, when the soil to be modified is cut by the cutter through the rotation of the drum, the cut-off soil is moved along the cutter. Therefore, the soil does not adhere to the cutter and, hence, the cutter does not clog with the soil.

According to a second aspect of the present invention, there is provided a soil modifying machine having a machine body to which are disposed a soil hopper, a soil conveyer for conveying a soil to be modified from the soil hopper, a soil conditioner supply device for supplying the soil conditioner to the soil and a mixer for crushing and mixing the conveyed soil and the soil conditioner to obtain a modified soil, the soil modifying machine being characterized in that the mixer is provided with a soil cutter device and a plurality of impact hammers and each of the impact hammers has a rotational shaft and a plurality of plate-shaped hammer pieces mounted to the rotational shaft.

According to this structure of the second aspect, since the impact hammer has a plate-like shape having a flat large beating surface, a good colliding efficiency with the material soil cut-off and dropped by the soil cutter can be obtained, and, hence, the particle size of the soil can be made fine. Therefore, even in a case where the soil lump having a large particle diameter is included in the soil to be modified, the particle diameter of the material soil can be made fine and the soil conditioner can fully infiltrate into the soil. Thus, the soil in the form of clay can be modified and effectively recycled as backfill or roadbed material.

In this structure, each of same hammer pieces may have a distal end in the shape of waveform.

According to this structure, since the distal end faces of the respective hammer pieces have waveformed shapes, when the material soil having a large particle size collides with this distal end portion, the soil to be modified collides only with the top portion thereof and does not collide with the bottom portion thereof, i.e. there is less area of the hammer distal end portion with which the soil collides, the colliding surface pressure (impact) is made large, so that the soil can be easily sheared and broken so as not to be spattered without being crushed and then effectively crushed.

Furthermore, since the respectively adjacent hammer pieces of the impact hammers are opposite to each other with a waveformed gap therebetween, the distance between the hammer pieces can be made small. Therefore, the soil passing between this gap is reduced in amount, thus the material soil crushing and mixing ability being improved.

According to the combined effects or functions mentioned above, the particle diameter of the soil can be surely made fine, thus remarkably improving the soil modifying effect.

According to the third aspect of the present invention, there is provided a soil modifying machine having a machine body to which are disposed a soil hopper, a soil conveyer for conveying a soil to be modified from the soil hopper, a soil conditioner supply device for supplying a soil conditioner to the soil, a mixer for crushing and mixing the conveyed soil and the soil conditioner to obtain a modified soil and a modified soil conveyer for conveying the modified soil, the soil modifying machine being characterized in that a rear side mixer is disposed for further crushing and mixing the modified soil discharged from the modified soil conveyer.

According to this structure, the soil and the soil conditioner are once crushed and mixed by the mixer to be the modified soil, which is thereafter further crushed and mixed by the rear side mixer to be the modified soil having a small particle size (diameter) even if the soil once modified by the mixer has a comparatively large particle size, whereby the soil conditioner can fully infiltrate into the soil to be modified, thus achieving an excellent soil modifying function. Therefore, the thus obtained modified soil can be effectively recycled as backfill or roadbed material.

Furthermore, there causes a case where the modified soil discharged from the mixer includes a large sized soil particle lump formed of a plurality of small sized ones at a time of being conveyed through the modified soil conveyer. However, in such a case, such large sized soil particles can be again crushed and mixed by the rear side mixer into small sized ones. Thus, the modified soil discharged from the rear side mixer is composed of small sized particles which can be surely visually observed as finely modified soil.

In this structure, the rear side mixer may be disposed at a discharge portion of the modified soil conveyer.

According to this structure, the rear side mixer can be moved together with the machine body.

Furthermore, in this structure, the rear side mixer is disposed independently of the machine body and disposed downstream side of the modified soil conveyer.

According to this structure, the rear side mixer can be arranged or removed in accordance with the condition of the soil to be modified.

The nature and further characteristic features of the present invention will be made more clear from the following descriptions made with reference to the accompanying drawings.

DESCRIPTION OF THE PREFERRED EMBODIMENTS

General Construction of Soil Modifying Machine

Figure 1:
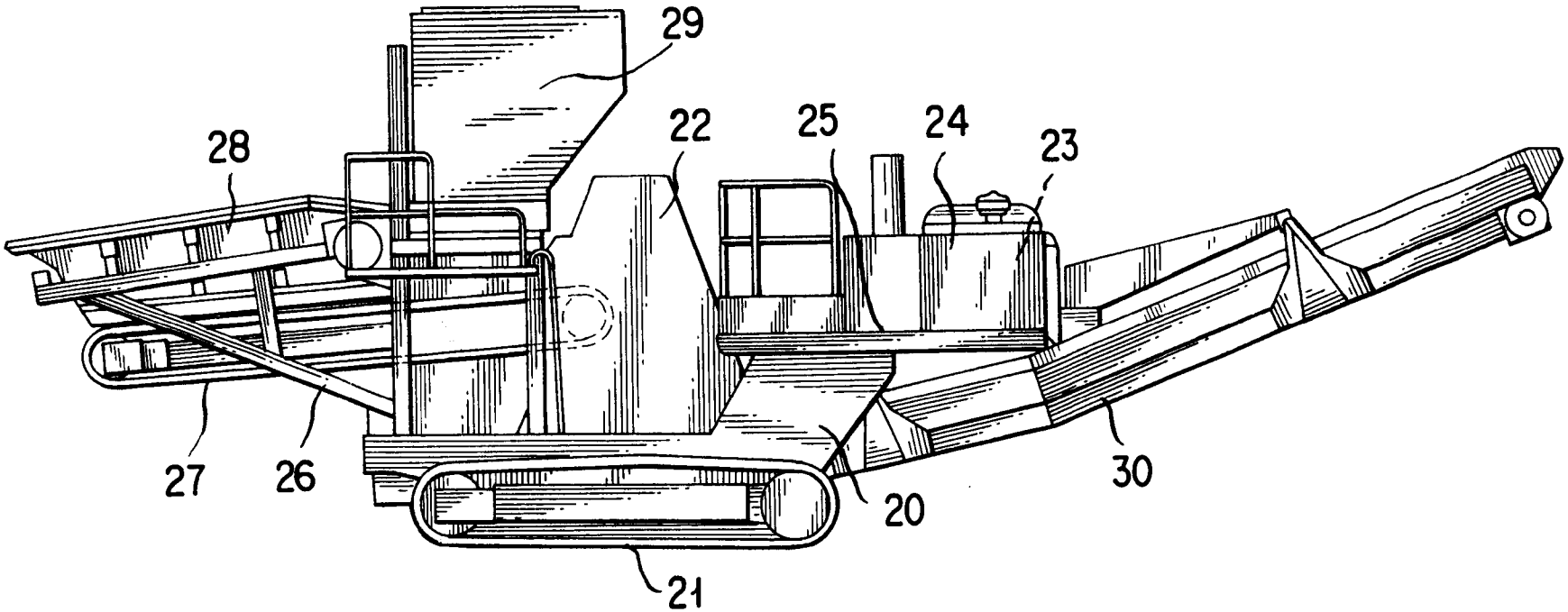
FIG. 1 is a side view showing a general structure of a self-advancing (crawler-type) soil modifying machine.

As shown in FIG. 1, a self-advancing machine (crawler-type vehicle) is constructed by a machine body 20 and a traveling members 21, 21 such as crawlers mounted to both lateral sides of the machine body 20. A mixer 22 is mounted to intermediate portion of the machine body 20 in the longitudinal direction thereof (vehicle traveling direction). Moreover, a power source unit 23 including an engine, hydraulic pump and the like is disposed at a front portion (right side as viewed in FIG. 1) of the machine body 20 and is covered by a cover 24. Further, in the illustrated embodiment, although the traveling members 21 are crawlers, a wheel-type structure may be instead adopted. A boarding platform 25 is also provided for the machine body 20.

A mount frame 26 is mounted to the machine body 20 at a portion on the rear side thereof so as to project rearward (left side as viewed) from the machine body 20, and a soil conveyer 27 for conveying a soil to be treated, e.g., a raw soil is also mounted to the mount frame 26 so as to extend in the longitudinal direction thereof. Furthermore, a soil hopper 28 is mounted to the mount frame 26 at a rear side upper portion of the soil conveyer 27. A soil conditioner supply device 29 is also mounted between the hopper 28 and the mixer 22 so as to cover the front side portion of the soil conveyer 27.

A modified soil conveyer 30 is mounted to a lower portion of the machine body 20 so as to extend in the longitudinal direction thereof. Further, as shown in FIG. 2, the modified soil conveyer 30 has one side portion (rear side portion) in the conveying direction, and this one side portion is positioned below the mixer 22 and has another side portion (front side portion) in the conveying direction, which extends forward over the machine body 20.

Although, in the described embodiment, the machine body 20 is mounted to the traveling member 21 such as crawlers, the soil modifying machine of the present invention may be constructed as a stationary soil modifying machine provided with no traveling member.

Structure of Soil Modifying Machine of First Embodiment

Figure 2:
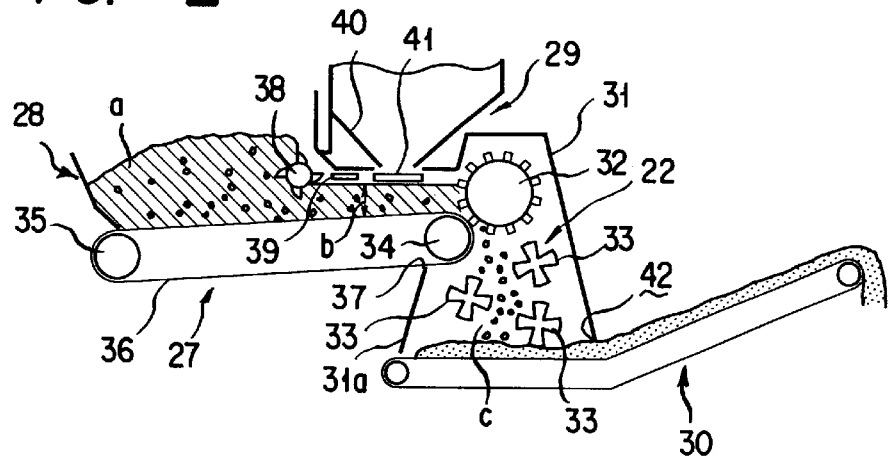
FIG. 2 is an illustration showing an essential structure of the soil modifying machine according to a first embodiment of the present invention.

FIG. 2 is an illustration showing an essential structure of the soil modifying machine according to a first embodiment of the present invention.

With reference to FIG. 2, the mixer 22 includes an outer case (or housing) 31, a soil cutter (cutting) device 32 as a primary mixer disposed inside the case 31 and a plurality of impact hammers (rotor provided with rotators) 33 as a secondary mixer.

The soil conveyer 27 is a conveyer which is composed of a driving wheel 34, a driven wheel 35 and an endless belt-like member 36 wound therearound. The soil conveyer 27 has a discharge side end portion which extends into the case 31 of the mixer 22 through an entrance port 37 formed to a side wall section 31*a* of the case 31 of the mixer 22. The endless belt-like member 36 is a crawler belt composed of a plurality of iron crawler plates which are connected in an endless shape, thus the crawler belt 36 having a high rigidity.

The hopper 28 in which the soil to be modified is thrown in has a discharge port at which a raking rotor 38 is disposed, the raking rotor 38 having one part for making constant the height b of a cut soil a. This height b means a height of the soil a conveyed by the soil conveyer 27 towards the mixer 22.

A soil sensor 39 for detecting a height of the soil is disposed above the soil conveyer 27, and this sensor 39 is switched over to "ON" state to detect the conveyance of the soil on the conveyer 27 at a time when the height of the soil a on the conveyer 27 becomes a predetermined height, for example, 70% of the height b.

The soil conditioner supply device 29 is provided with a fixed quantity (constant amount) supply mechanism 41 at an outlet portion of a hopper 40.

As mentioned hereinbefore, the modified soil conveyer 30 has the rear side portion of the machine body in the conveying direction, which is positioned below a discharge port 42 of the case 31 of the mixer 22.

Explanation of The Soil Modifying Machine of The First Embodiment

With reference to FIG. 2, the soil a in the form of clay such as dewatered cake fed into the soil hopper 28 is adjusted by the soil conveyer 27 and the raking rotor 38 so as to provide a predetermined cut height and then conveyed to the mixer 22. When the soil a is conveyed, the sensor 39 is made "ON" and the fixed quantity supply mechanism 41 is thereby operated. In thus manner, the soil conditioner falls in the hopper 28 through the fixed quantity supply mechanism 41.

The mixture of the soil to be modified a and the soil conditioner conveyed in the mixer 22 are cut off by the soil cutter device 32 and then crushed, mixed and stirred by the impact hammers 33, whereby the nature and condition of the soil a can be modified as a modified soil c, which is then fallen and supplied onto the modified soil conveyer 30 through the discharge port 42 formed to the case 31 of the mixer 22, and thereafter, conveyed by the modified soil conveyer 30 forward the machine body.

The soil cutting device 32 has the following structure.

Figure 3:
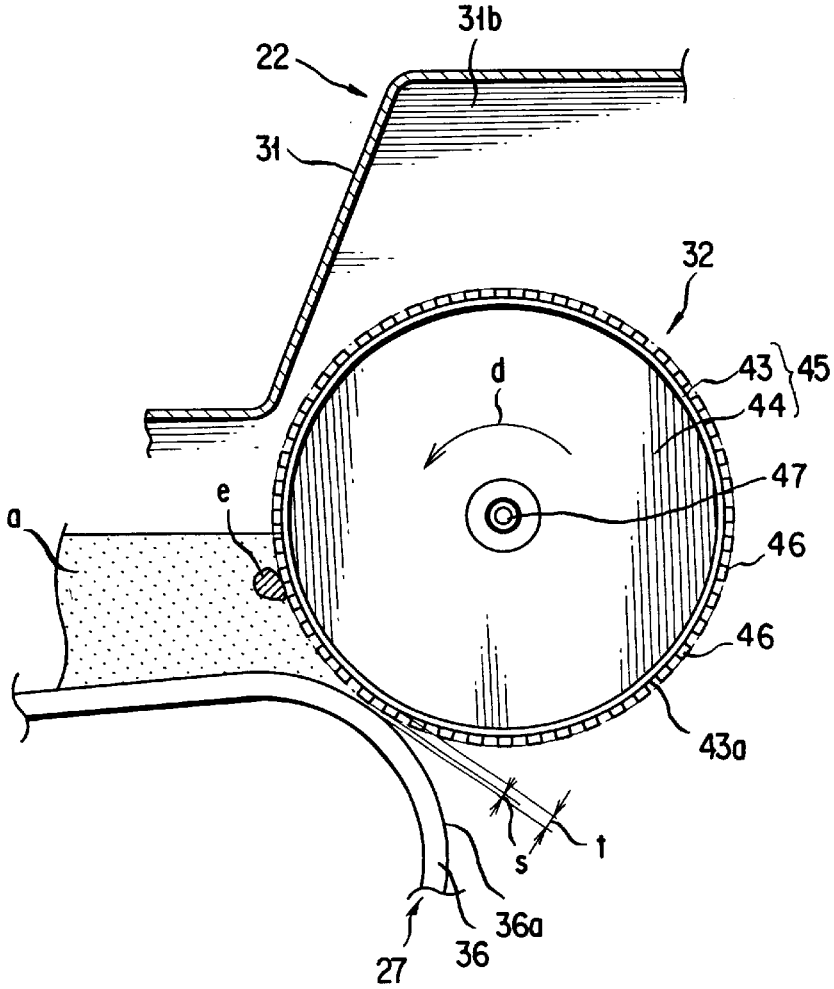
FIG. 3 is a vertical sectional view showing a soil cutter device of a mixer, in an enlarged scale, according to the first embodiment of FIG. 2.
Figure 4:
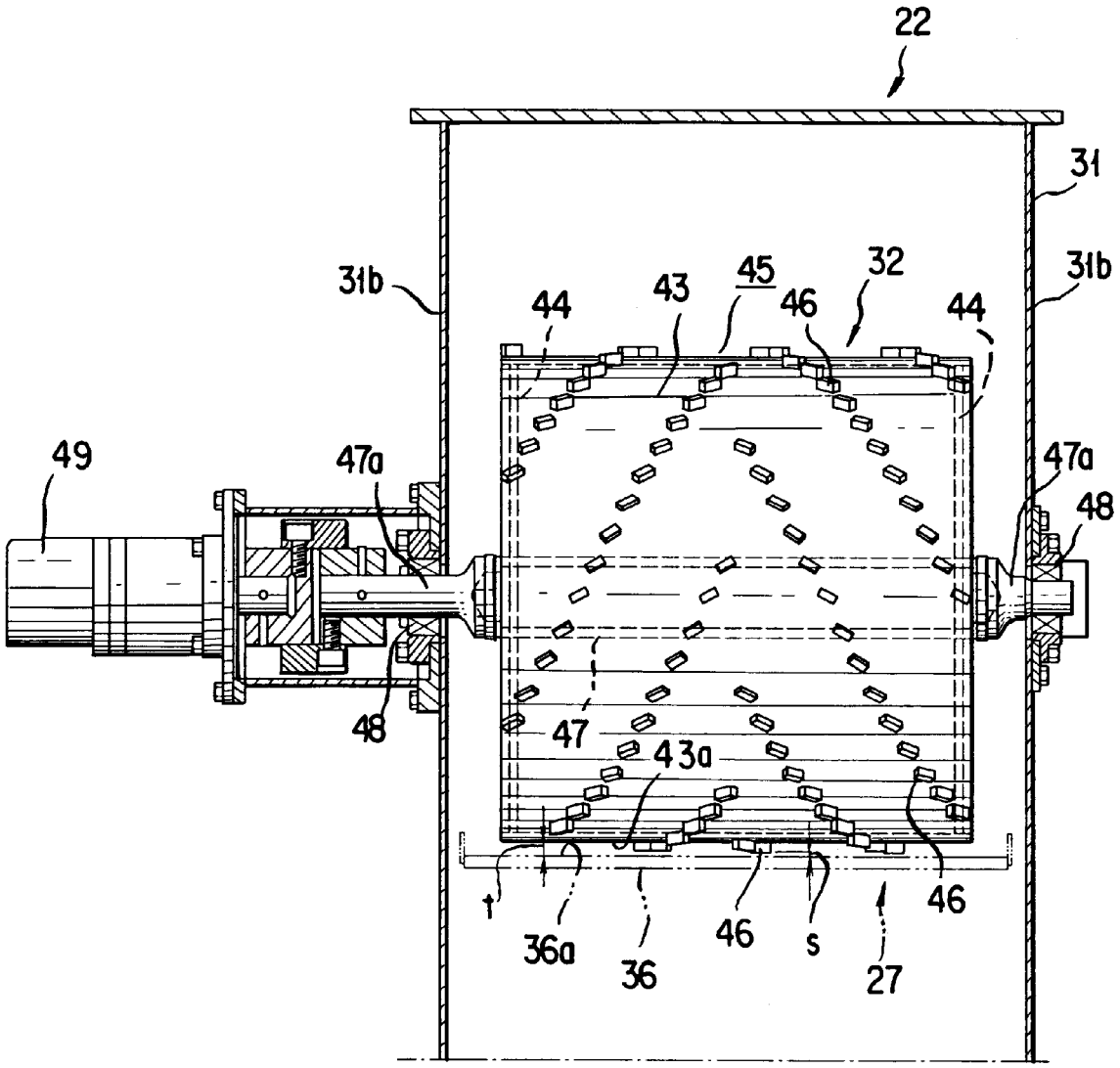
FIG. 4 is a horizontal sectional view showing a soil cutter device of a mixer, in an enlarged scale, according to the first embodiment of FIG. 2.

As shown in FIGS. 3 and 4, the soil cutter device 32 is of a drum-type structure comprising a drum 45 composed of a cylindrical body 43 and end plates 44 secured to both axial end portions of the cylindrical body 43 and a plurality of cutters (cutter pieces) 46 secured to the outer peripheral portion 43*a* of the cylindrical body 43 (i.e. drum 45).

The drum 45 is supported to be rotatable by a shaft 47 passing through central portions of both the end plates 44, the shaft 47 having both ends 47*a* supported by side walls 31*b*, 31*b* of the case 31 of the mixer 22 through bearings 48, 48.

The shaft 47 has an end portion 47*a* coupled to a rotational portion of a motor 49 mounted to one side wall 31*b* so that when the motor 49 is driven, the soil cutter device 32 is rotated in a direction of an arrow d in FIG. 3.

Each of the cutters 46 has a plate member having a rectangular shape, and a protruding length (height) of the cutter 46 extending from the outer peripheral surface 43*a* of the cylindrical body 43 is set to be substantially equal to or slightly smaller than a target diameter of a particle of the soil to be modified, for example, to 15 mm. These cutters 46 are arranged so that the front end portions thereof are opposite to the surface 36*a*, with a slight gap or clearance S, of an endless belt member of the soil conveyer 27. The gap S is, for example, set to 5 mm. Accordingly, the minimum gap t between the outer peripheral surface 43*a* of the cylindrical body 43 and the surface 36*a* (i.e. soil conveying surface) of the endless belt member 36 of the soil conveyer 27 is substantially equal to or slightly smaller than a target diameter of the particle of the soil to be modified, for example, 20 mm.

As mentioned above, as shown in FIG. 3, the soil a conveyed by the soil conveyer 27 is cut at a predetermined thickness by the cutters 46 through the rotation of the soil cutter device 32. This thickness is substantially the same as or smaller than the minimum gap t mentioned above, and for example, is set to be 20 mm or less.

Furthermore, as shown in FIG. 3, in a case where a lump of clay e, which cannot be cut off by the cutters 46, exists in the soil to be modified a, the lump of clay e is moved gradually through the contacting or beating of the respective cutters 46 and then falls through the minimum gap between the outer peripheral surface 43*a* of the cylindrical body 43 and the surface 36*a* of the endless belt member 36 of the conveyer 27.

The size (i.e. diameter) of the particle of the clay lump e which can fall is substantially equal to or smaller than the minimum gap between the outer peripheral surface 43*a* of the cylindrical body 43 and the surface 36*a* of the endless belt member 36 and the clay lump e having a particle size larger than that mentioned above does not fall. In this embodiment, the gap is set so that the clay lump having a particle size of about 20 mm falls.

Further, although the crushing and mixing ability of the soil to be modified becomes improved with the smaller protruding length (height) of the cutter 46 and the smaller gap S, as the protruding length and the gap S are made smaller, the working efficiency will become worse. Accordingly, the protruding length may be sometime set to be slightly larger than the aimed (target) particle diameter of the crushed soil, and for example, the protruding length may be set to 30 mm with respect to the aimed particle diameter of 20 mm.

The endless belt member 36 has a crawler structure that formed by endlessly coupling a plurality of iron crawler plates. Since such endless belt member 36 has a large rigidity, it is not deformed even if it is pushed by the clay lump e during the passing through the minimum gap portion. Thus, the clay lump e having a size larger than the minimum gap never pass the gap and does not fall downward.

The soil to be modified and the soil conditioner cut off by the soil cutter device 32 are then further crushed and mixed by a plurality of impact hammers 33 disposed below the soil cutter device 32 to thereby form the modified soil c, which then fall on the modified soil conveyer 30 and conveyed thereby out of the machine body 20.

The modified soil, which is obtained by mixing the dewatered cake with cement as soil conditioner by using the drum-type soil cutter device 32 mentioned above and the mixer 22 having the impact hammers 33 of the conventional structure, is the soil which can be recycled as the backfill, roadbed material or like. For example, the modified soil having a mixing ratio (5–10%) of the large clay lump having the particle diameter of more than 20 mm can be recycled as the backfill and the roadbed material.

The cutters 46 mentioned above includes a plurality of one-side cutter rows 50 secured to the one side portion 43*b* of the outer peripheral surface of the cylindrical body 43 with intervals in the circumferential direction thereof and a plurality of another-one side cutter rows 51 secured to the another side portion 43*c* of the outer peripheral surface of the cylindrical body 43 with intervals in the circumferential direction thereof. These one and another cutter rows 50 and 51 are obliquely arranged so as to provide approximately V-shapes in the rotational direction of the cylindrical body 43.

According to this arrangement of the cutters 46, when the material soil is cut off by the cutters 46, the cut-off material soil is moved towards the axial central portion of the cylindrical body 43 and then falls from the central portion thereof so that the cut-off material soil does not fall from both the axial end portions of the cylindrical body 43. Therefore, since the cut-off material soil concentrically falls on the axial central portion of the impact hammers 33, the material soil can be efficiently crushed and mixed by the impact hammers 33.

The cutters 46 constituting the one-side rows 50 are arranged adjacently with intervals in the circumferential direction (rotational direction) of the cylindrical body 43 in the manner overlapped in a direction parallel to the axis of the cylindrical body 43 and provided with a predetermined oblique inclination angle of $\alpha$ with a direction parallel to the axis of the cylindrical body 43. The cutter 46 has an axial one end portion 46*a* which is positioned on the front side in the rotational direction with respect to the other end portion 46*b*, and the inclination of $\alpha$ is set in a range of 15 to 40 degs. for example, 30 degs. in FIG. 5.

The cutters 46 constituting the other one-side rows 51 are arranged adjacently with intervals in the circumferential direction (rotational direction) of the cylindrical body 43 in the manner overlapped in a direction parallel to the axis of the cylindricl body 43 and provided with a predetermined oblique inclination angle of $\alpha$ with a direction parallel to the axis of the cylindrical body 43. The cutter 46 has an axial one end portion 46*b* which is positioned on the front side in the rotational direction with respect to the other end portion 46*a*, and the inclination of $\alpha$ is set in a range of 15 to 40 degs. for example, 30 degs. in FIG. 5.

As mentioned above, when the material soil is cut off by the cutters 46, the cut-off soil is moved along the cutters 46, so that the cut-off soil does not adhere the cutters 46 and the cutters 46 do not clog with the soil.

The above matter will be applicable in a case of the soil in the form of clay such as dewatered cake.

Figure 5:
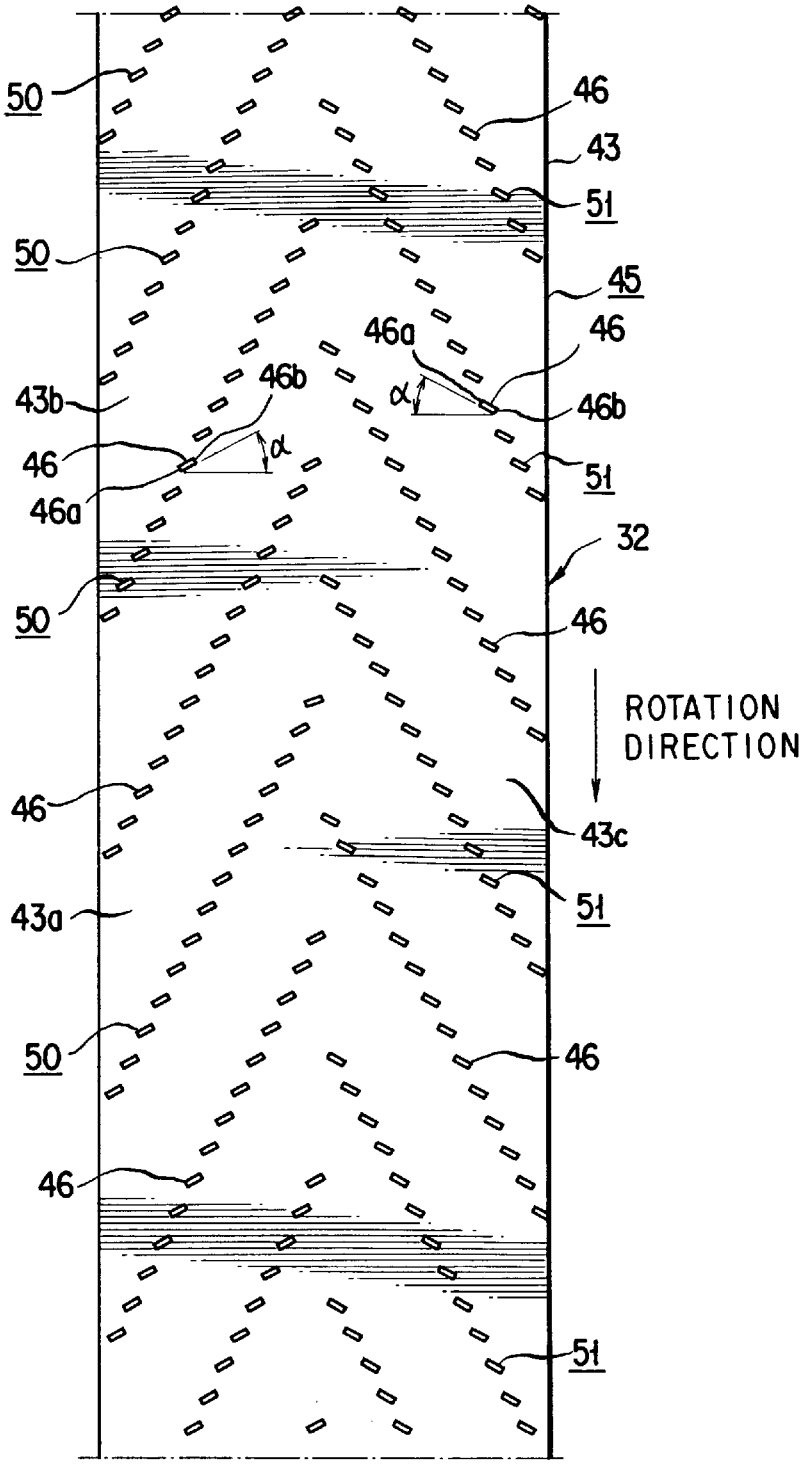
FIG. 5 is a developed view of a soil cutter drum showing a first example of arrangement of the cutters.

Further, the number of the cutters 46 is not limited to that shown in FIG. 5 and increased or decreased number thereof may be adopted.

Figure 6:
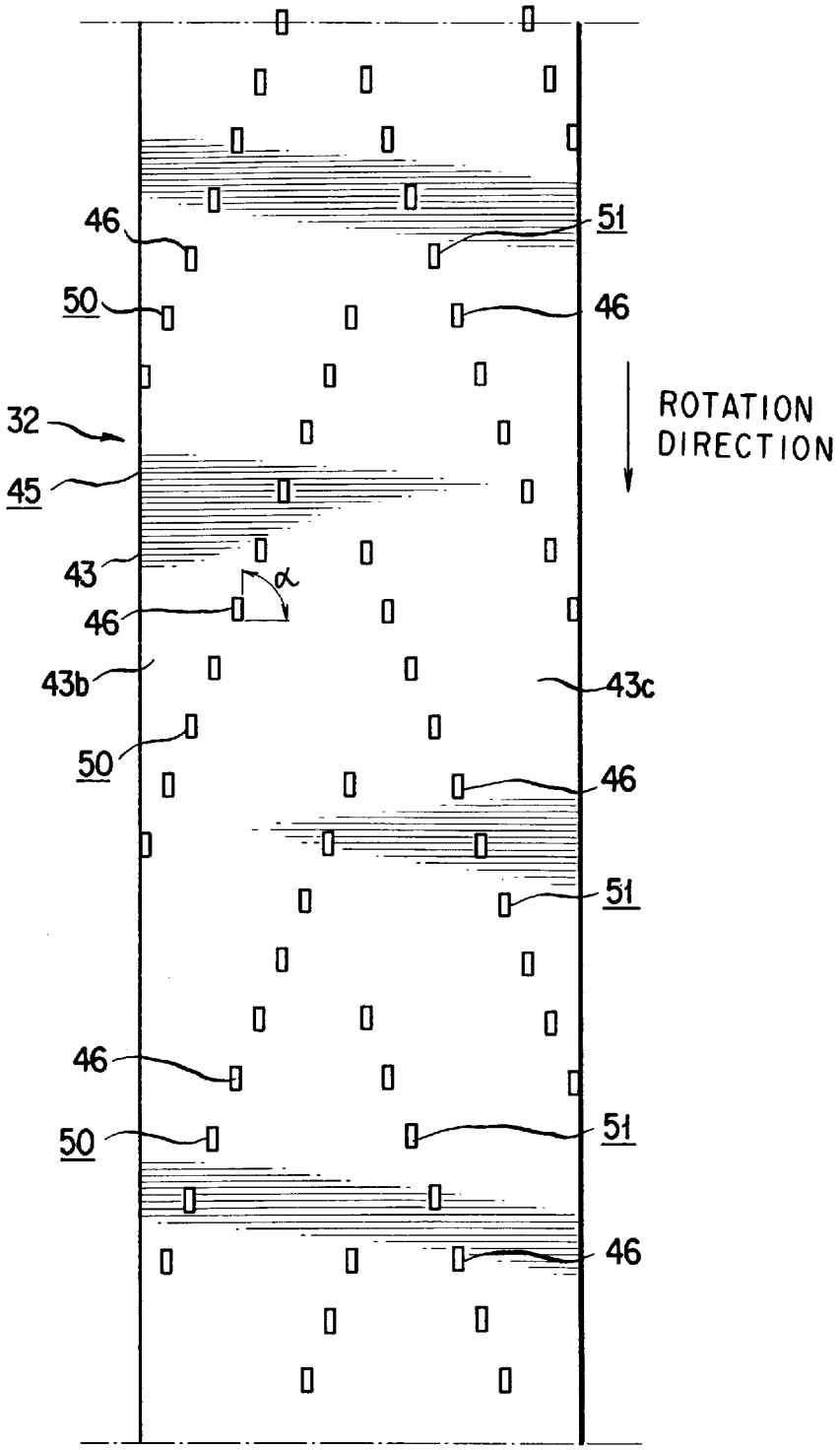
FIG. 6 is a developed view of a soil cutter drum showing a second example of arrangement of the cutters.
Figure 7:
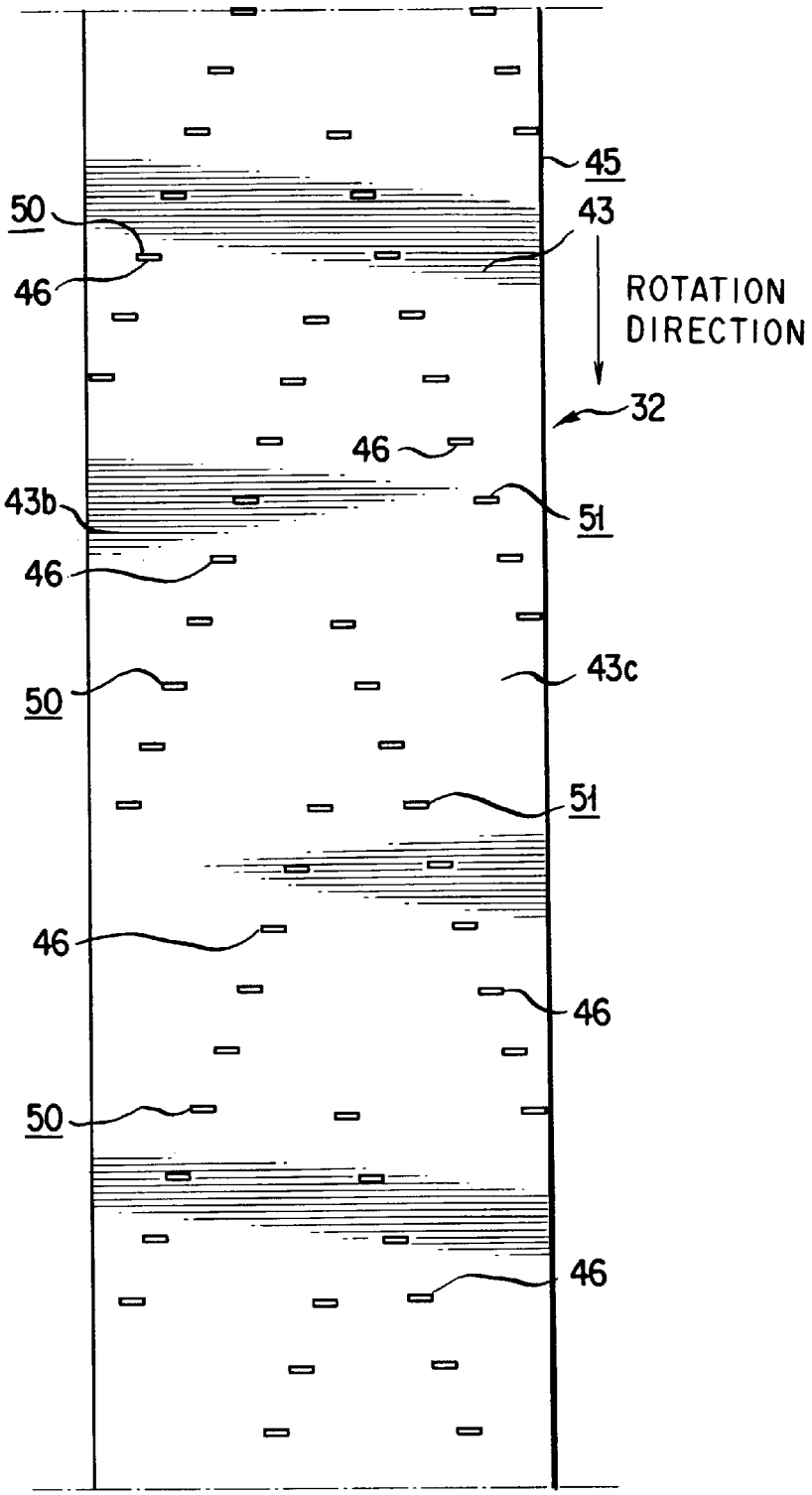
FIG. 7 is a developed view of a soil cutter drum showing a third example of arrangement of the cutters.

Furthermore, in no consideration of the adhering of the material soil to the cutters and in consideration of achieving the aim of making the soil in fine particles, the arrangement of the cutters 46 may be made as shown in FIG. 6 in which the inclination $\alpha$ of the cutter 46 is 90 degs. or as shown in FIG. 7 in which the inclination $\alpha$ is 0 deg. with respect to the direction parallel to the rotational direction.

Figure 8:
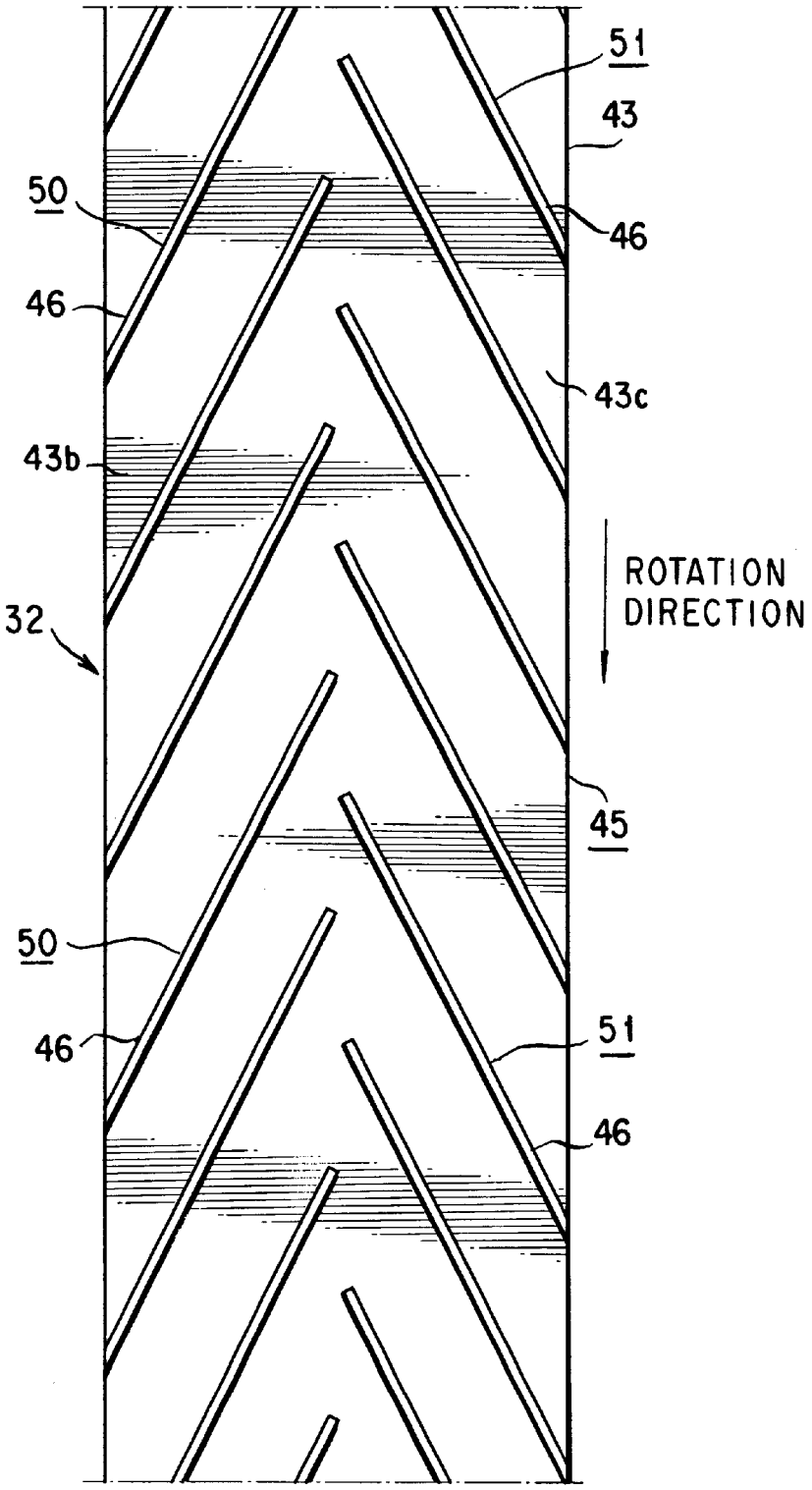
FIG. 8 is a developed view of a soil cutter drum showing a fourth example of arrangement of the cutters.
Figure 9:
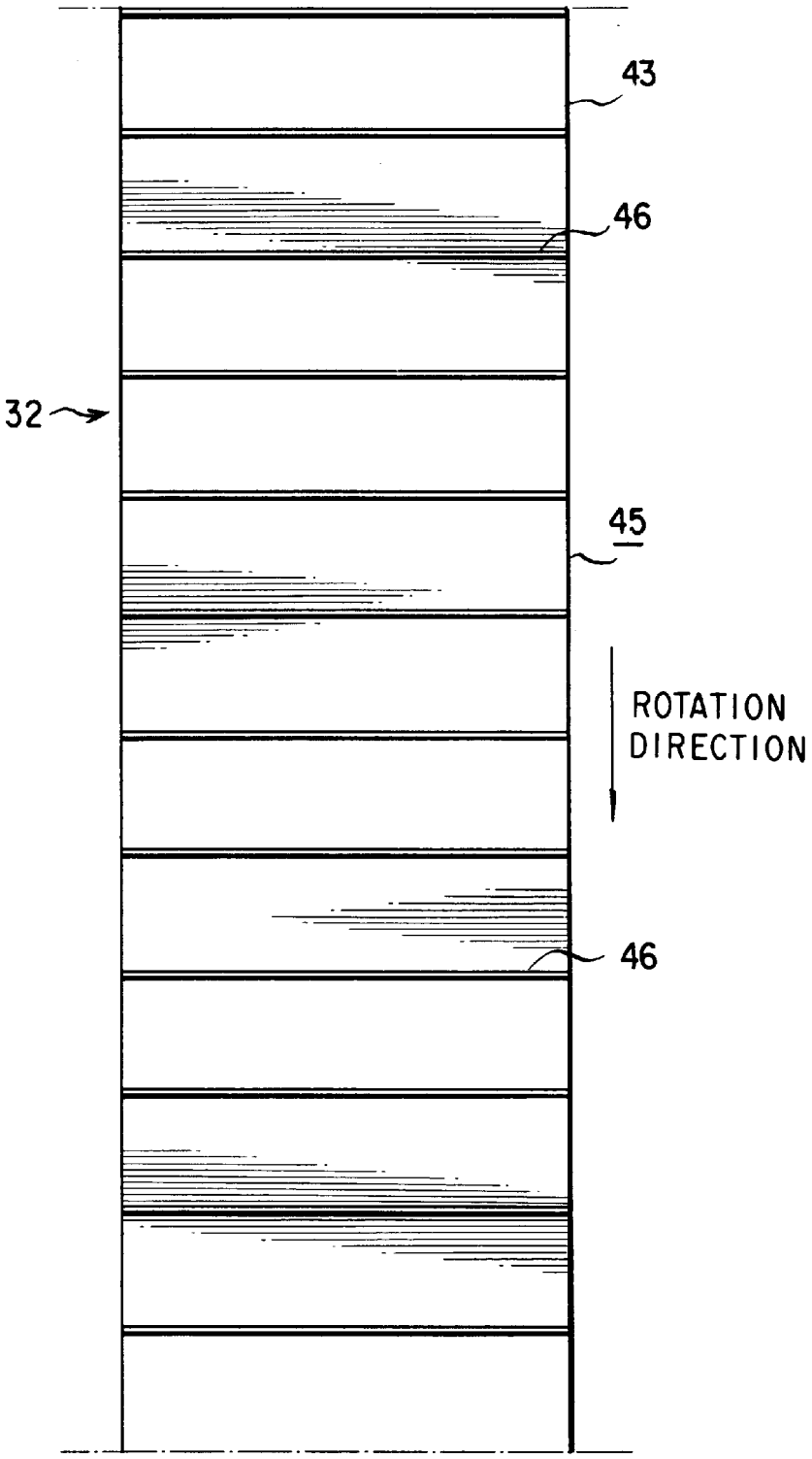
FIG. 9 is a developed view of a soil cutter drum showing a fifth example of arrangement of the cutters.

Still furthermore, as shown in FIG. 8, each of the one-side cutter rows 50 and each of the other one-side cutter rows 51 may be constituted as oblique continuous cutters 46 having a long scale, or as shown in FIG. 9, each of the one-side cutter rows 50 and each of the other one-side cutter rows 51 may be constituted as continuous horizontal one cutter 46 having a long scale. In these examples, the rows of cutters 46 are arranged in parallel with each other with a predetermined interval.

Further, the cutters 46 may be fixed by means of bolts.

Structure of Soil Modifying Machine of Second Embodiment

Figure 10:
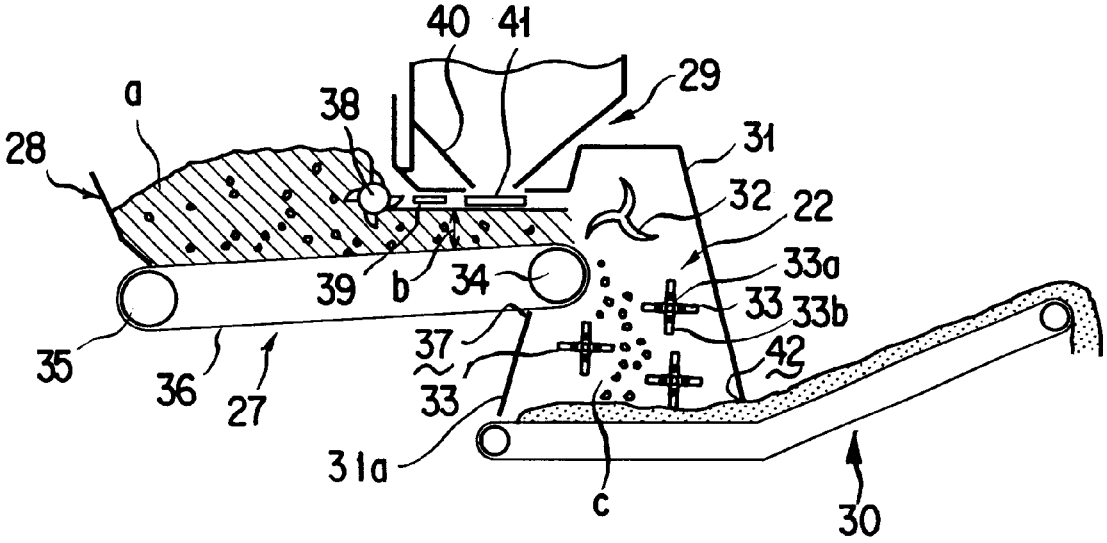
FIG. 10 is an illustration showing an essential structure of the soil modifying machine according to a second embodiment of the present invention.

FIG. 10 is an illustration showing an essential structure of the soil modifying machine according to a second embodiment of the present invention.

With reference to FIG. 10, the structures of the soil conveyer 27, the soil hopper 28, the soil conditioner supply device 29 and the modified soil conveyer 30 are the same as those of the first embodiment mentioned hereinbefore. Further, although the soil cutter device 32 of the mixer 22 also has the same structure as that of the conventional one, the structure of the impact hammers 33 of the mixer 22 is different from that of the conventional one. That is, the impact hammer 33 of this embodiment has a plate-shape structure in which four plate-shaped hammer pieces 33*b* are mounted to a rotational shaft 33*a* so as to extend radially therefrom.

The specific arrangement of the impact hammers 33 of this embodiment will be described hereunder.

Figure 11:
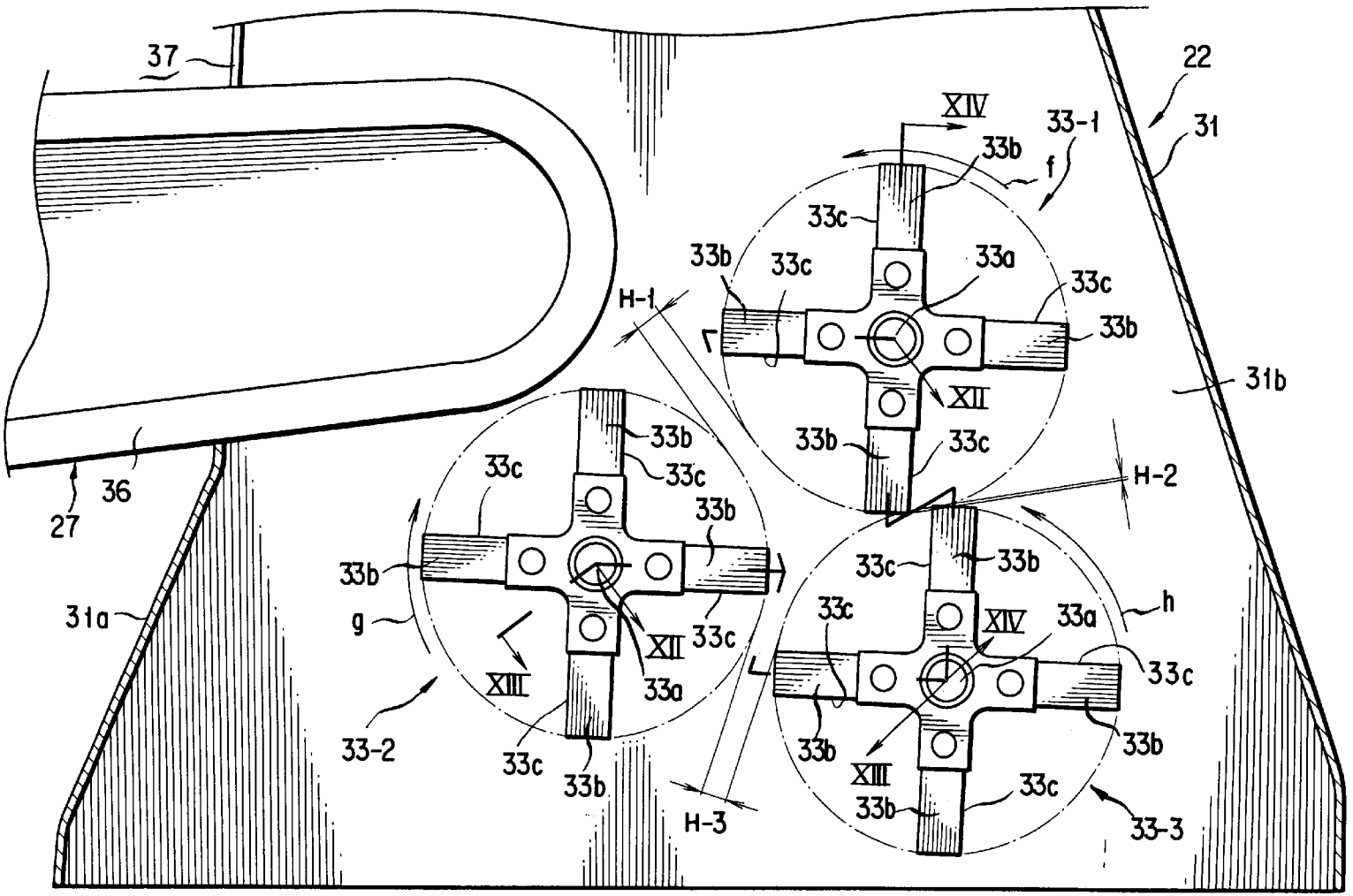
FIG. 11 is an illustrated sectional view, in an enlarged scale, of a first example of arrangement of impact hammers of a mixer of the second embodiment of FIG. 10.

Referring to FIG. 11, the impact hammers 33 includes a first impact hammer 33-1 disposed on substantially the same level as the location of the soil conveyer 27, a second impact hammer 33-2 disposed below the soil conveyer 27 and a third impact hammer 33-3 disposed below the first and second impact hammers 33-1 and 33-3 in a relation opposite thereto.

The first impact hammer 33-1 is rotated in a direction of an arrow f, the second impact hammer 33-2 is rotated in a direction of an arrow g and the third impact hammer 33-3 is rotated in a direction of an arrow h.

A minimum distance H-1 between the front end of each hammer piece 33*b* of the first impact hammer 33-1 and the front end of each hammer piece 33*b* of the second impact hammer 33-2 is set to be large, for example, to 50 mm as viewed from the side of the arrangement thereof.

A minimum distance H-2 between the front end of each hammer piece 33*b* of the first impact hammer 33-1 and the front end of each hammer piece 33*b* of the third impact hammer 33-3 is set to be small, for example, to −5 mm. That is, both the front end portions of the first and third impact hammers are overlapped by 5 mm as viewed from the side of the arrangement thereof.

A minimum distance H-3 between the front end of each hammer piece 33*b* of the second impact hammer 33-1 and the front end of each hammer piece 33*b* of the third impact hammer 33-3 is set to be middle, for example, to 15 mm.

With reference to FIGS. 11 to 14, the rotational shafts 33*a* of the respective impact hammers 33-1, 33-2 and 33-3 are supported to be rotatable by the lateral side wall portions 31*b*, 31*b* of the case 31 of the mixer 22, the respective rotational shafts 33*a* being driven and rotated by electric motors M, for example.

To the rotational shaft 33*a*, there are fixed first, second and third brackets 52, 53 and 54 in pairs with an interval in the axial direction. Base portions of four first hammer pieces 55 equally arranged in the circumferential direction of the rotational shaft 33*a* are mounted to the first bracket pair 52 by means of pins 56 to be rockable (swingable). Base portions of four second hammer pieces 57 equally arranged in the circumferential direction of the rotational shaft 33*a* are mounted to the second bracket pair 53 by means of pins 58 to be rockable. Furthermore, base portions of four third hammer pieces 59 equally arranged in the circumferential direction of the rotational shaft 33*a* are mounted to the third bracket pair 54 by means of pins 60 to be rockable. Further, these hammer pieces 55, 57 and 59 correspond to (i.e. commonly referred to as) the hammer pieces 33*b* mentioned hereinbefore.

Each of the first and third hammer pieces 55 and 59 has a plate structure having a base portion 55*a*, 59*a* having a narrow width and a front end portion 55*b*, 59*b* having a wide width, and the distal end face 55*c*, 59*c* thereof has a waveform. Each of the second hammer pieces 57 has a plate structure having a width smaller than that of the first or third hammer piece 55, 59 and having a base portion 57 and a front end portion 57*b* of the same width, and the distal end face 57*c* provides approximately a V-shape.

The distal end faces 55*c*, 57*c* and 59*c* of the first, second and third hammer pieces 55, 57 and 59 of the first impact hammer 33-1 are approximately continuous in the shape of waveform.

In the second hammer piece 57 of the second impact hammer 33-2 and the second hammer piece 57 of the third impact hammer 33-3, the front end portion 57*b* is slightly wider than the base portion 57*a*, and the distal end portion 57*c* provides a mount (angled) shape. The distal end faces 55*c*, 57*c* and 59*c* of the first, second and third hammer pieces 57 and 59 of theses impact hammer 33-2 and 33-3 are also approximately continuous in the shape of waveform.

The front side surfaces (i.e. the beating surfaces 33*c* of the hammer pieces 33*b*) in the rotational directions of the first, second and third hammer pieces 55, 57 and 59 provide flat surfaces and a distance between the rotational center and the front end portion of each hammer piece is made longer than that of the conventional structure and larger in the width thereof than that of the conventional structure, thus an area thereof being larger than that of the conventional one.

Figure 12:
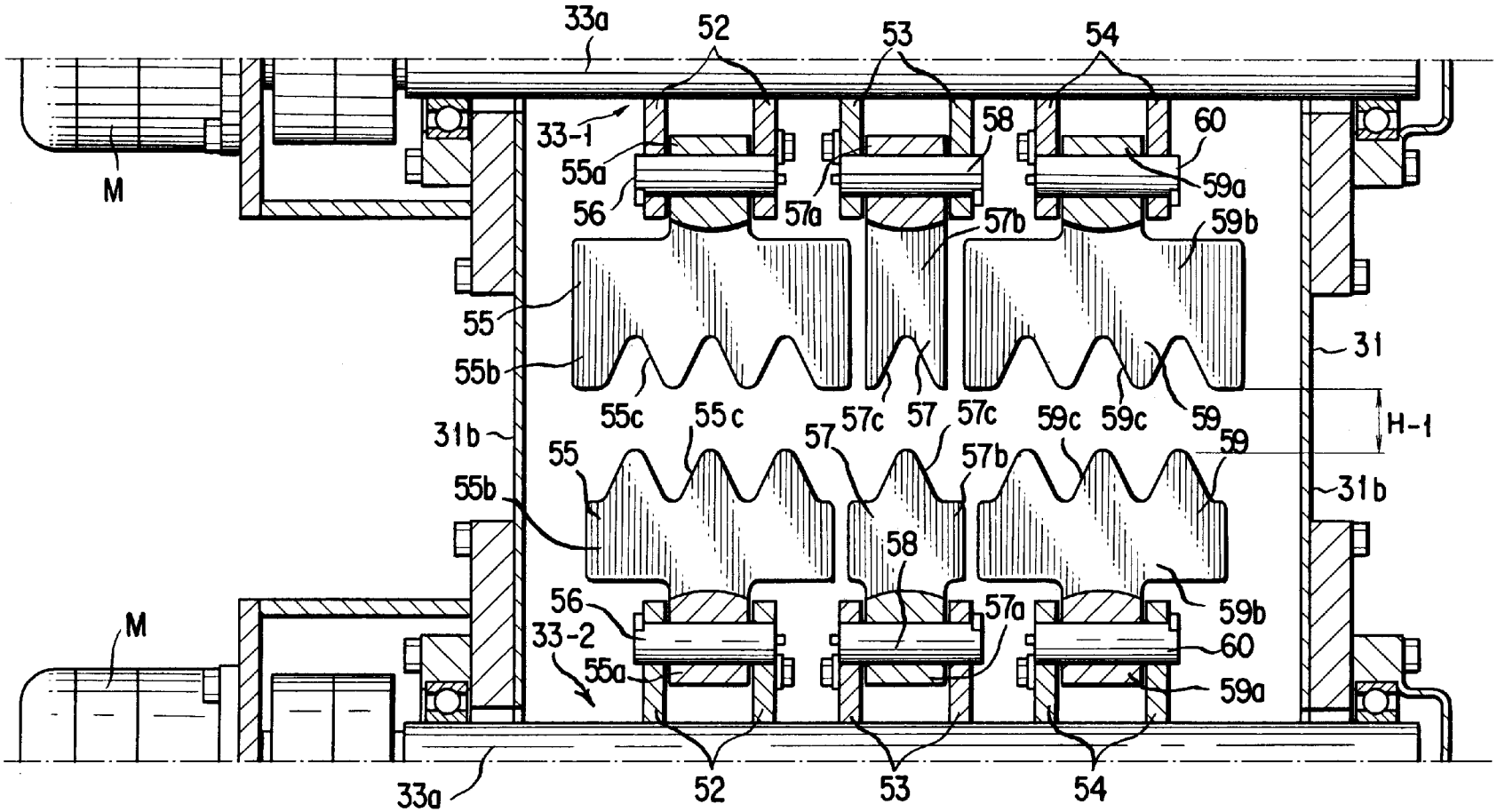
FIG. 12 is a sectional view taken along the line XII—XII of FIG. 11.

The first, second and third hammer pieces 55, 57 and 59 of the respective first and second impact hammers 33-1 and 33-2 have top portions and bottom portions in the waveforms, which are opposed in a shifted manner to each other as shown in FIG. 12. In other words, the waveforms of the respective hammer pieces of the first and second impact hammers are shifted by ½pitch from each other, and the distance between the top portions thereof corresponds to the minimum width H-1 mentioned hereinbefore.

Figure 13:
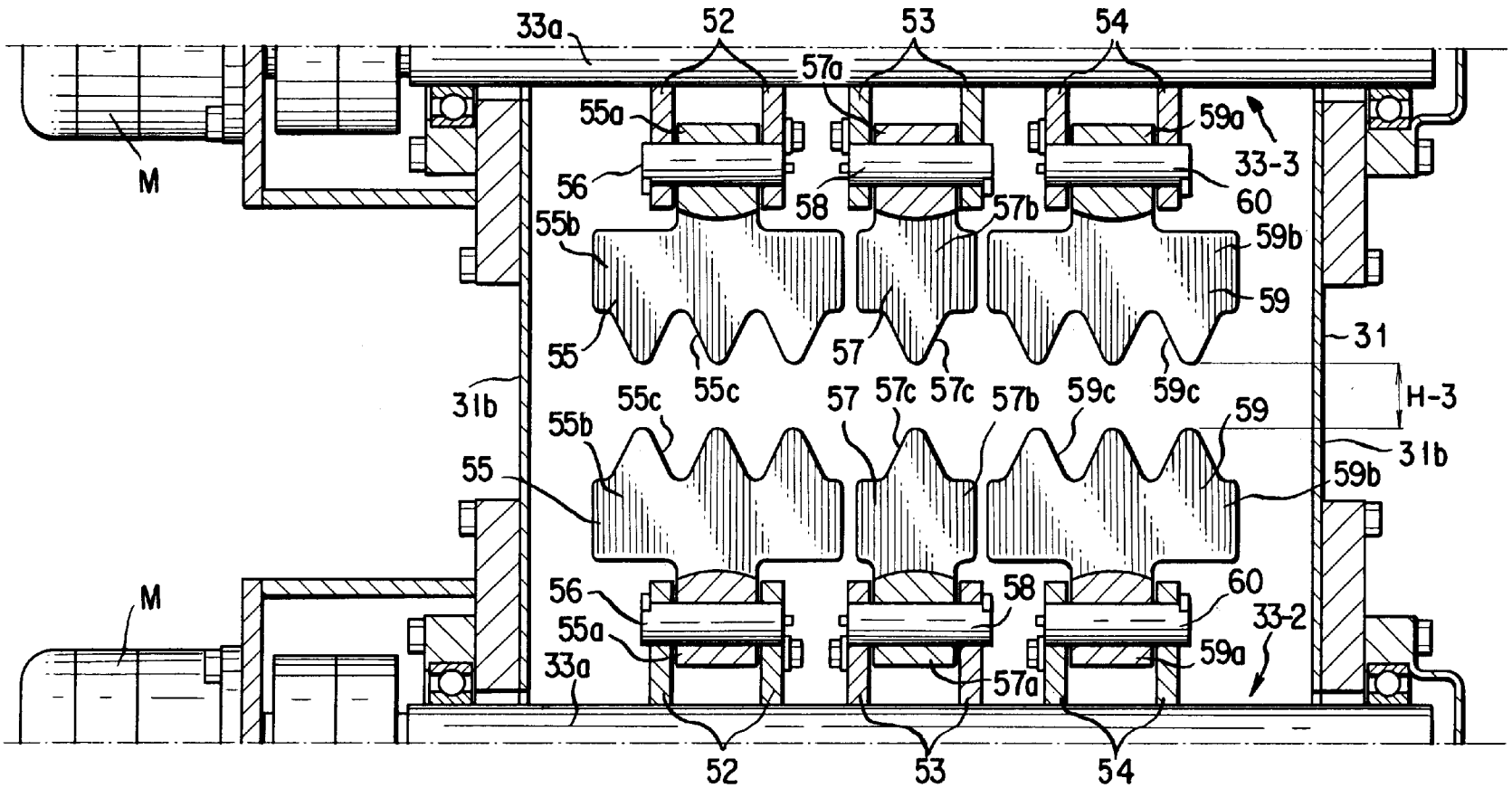
FIG. 13 is a sectional view taken along the line XIII—XIII of FIG. 11.

On the other hand, the first, second and third hammer pieces 55, 57 and 59 of the respective second and third impact hammers 33-2 and 33-3 have top portions and bottom portions in the waveforms, which are correspondingly opposed to each other as shown in FIG. 13, and the distance between the top portions thereof corresponds to the minimum width H-3 mentioned hereinbefore.

Figure 14:
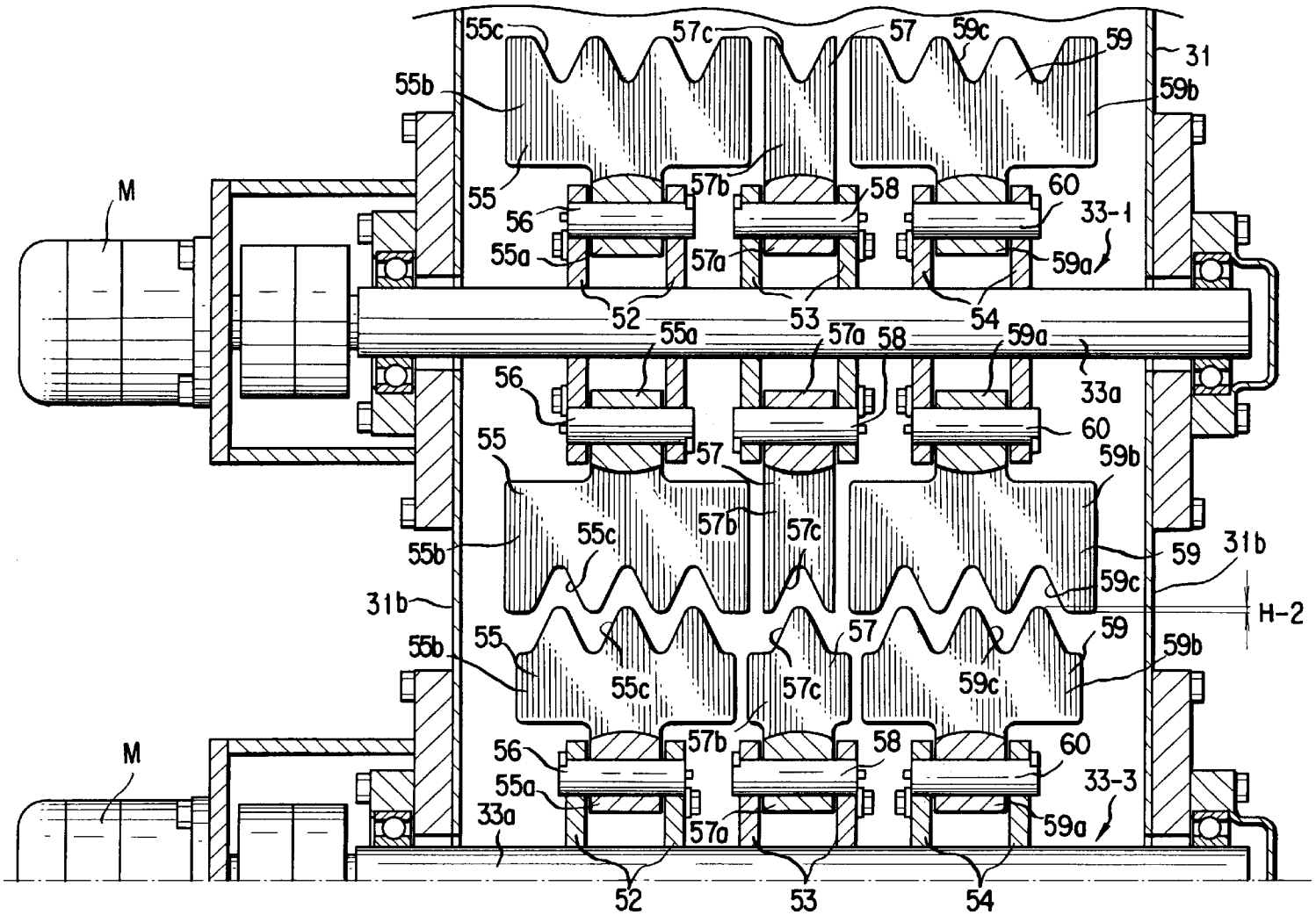
FIG. 14 is a sectional view taken along the line XIV—XIV of FIG. 11.

Furthermore, the first, second and third hammer pieces 55, 57 and 59 of the respective first and third impact hammers 33-1 and 33-3 have top portions and bottom portions in the waveforms, which are opposed in the shifted manner to each other as shown in FIG. 14, and the top portions of the waveforms slightly protrude into the bottom portions thereof so that the distance between the top portions of the waveforms takes a minus value, that is, both waveforms have overlapped portions.

According to the arrangement of the impact hammers mentioned above, the minimum distance H-2 is a minus value, and an area of the space between the respective hammer pieces of the first impact hammer 33-1 and the respective hammer pieces of the third impact hammer 33-3 is small and, hence, a very small amount of the soil can pass therebetween without being subjected to the crushing operation.

The material soil cut-off by the soil cutter device 32 is crushed by the respective hammer pieces of the impact hammers 33, and during this process, the soil conditioner is mixed to thereby provide the modified soil.

As mentioned hereinbefore, according to the structure that the beating surfaces of the hammer pieces are formed to be flat surfaces having the large area, colliding efficiency at the time of colliding with the soil can be improved and, hence, the crushing performance can be enhanced, thus the soil being effectively crushed into fine particles. Therefore, the infiltration of the soil conditioner into the soil to be modified can be improved.

As mentioned above, according to this embodiment of the present invention, in an occasion that the clay lump exists in the soil which is not cut by the soil cutter device 32, the clay lump can be crushed into small lumps by the impact hammers 33. Accordingly, the modified soil, which is prepared by mixing the dewatered cake and the cement as the soil conditioner by using the mixer 22 provided with the impact hammers 33 of the structure mentioned above according to the present invention and the soil cutter device 32 of the conventional structure, has the nature of soil which can be recycled as the backfill, roadbed material or like. Such modified soil is, for example, a soil in which particles each having a large diameter larger than 20 mm is mixed at a mixing ratio of 5 to 10%, which can be recycled as the backfill and roadbed material.

Moreover, since each of the hammer pieces has a flat plate shape, the hammer piece can be easily and cheaply manufactured by cutting a plate member, and the hammer piece may be manufactured as a forged product.

Furthermore, the distal end face of the hammer piece provides the waveform, when a large sized soil collides with the distal end face of the hammer piece, the top portion thereof collides with the soil and the bottom portion does not collide, so that the distal end face portion of each hammer piece has a small area colliding with the material at a high bearing pressure (surface pressure).

As mentioned above, the material soil can be easily sheared and is not splashed around without being crushed, thus being effectively crushed. That is, if the soil is splashed without being crushed, there may cause a case that the splashed soil collides with the soil which is moving towards the impact hammers and the moved soil does not reach the hammer pieces. According to the present invention, such occasion cannot be prevented from causing.

Furthermore, the hammer pieces of the adjacent two impact hammers are opposed each other with the wave-shaped space, so that the distance therebetween can be made small, whereby the amount of the soil which passes the space between the impact hammers can be reduced, thus improving the crushing and mixing performance.

Figure 15:
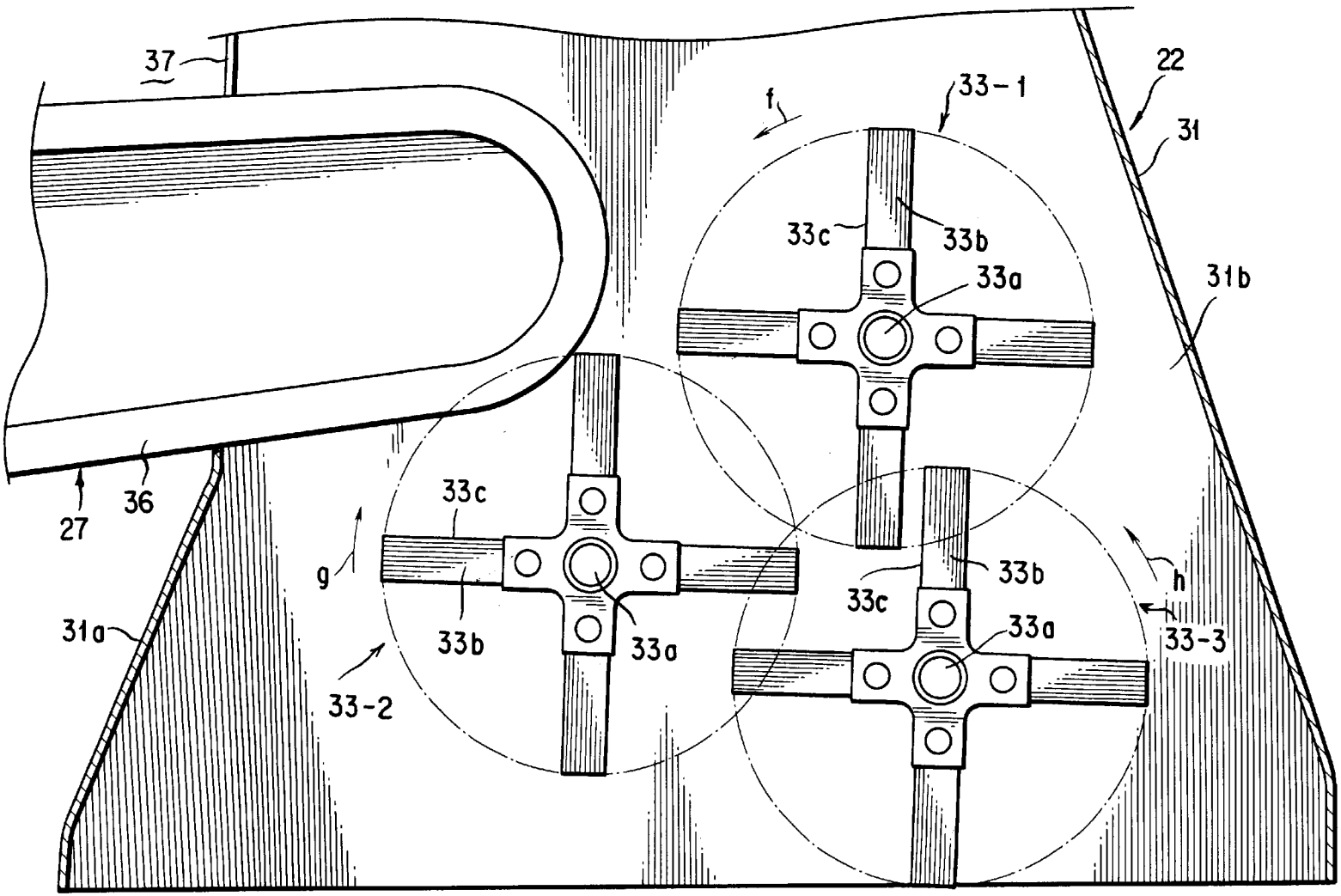
FIG. 15 is an illustrated sectional view, in an enlarged scale, of a second example of arrangement of impact hammers of a mixer of the second embodiment of FIG. 10.

Further, as shown in FIG. 15, in an alternation, it may be possible to construct the respective impact hammers so as to overlap the front end portions of the respective hammer pieces 33*b* of the first impact hammer 33-1 and the front end portions of the respective hammer pieces 33*b* of the second impact hammer 33-2; the front end portions of the respective hammer pieces 33*b* of the first impact hammer 33-1; and the front end portions of the respective hammer pieces 33*b* of the third impact hammer 33-3, and the front end portions of the respective hammer pieces 33*b* of the second impact hammer 33-2 and the front end portions of the respective hammer pieces 33*b* of the third impact hammer 33-3, with each other.

According to such an alternation, the distance from the rotational center of each of the impact hammers to the front end face of the hammer piece 33*b* is made long, and hence, the beating area of the beating surface 33*c* of the hammer piece 33*b* is increased, thus further improving the crushing ability. Therefore, the soil to be modified can be crushed more finely, and hence, the infiltration of the soil conditioner can be further improved.

Further, the distal end faces of the respective hammer pieces may be formed as flat faces, and the respective hammer pieces 33*b* are directly mounted to the rotational shaft 33*a* so as not to be swung.

Structure of Soil Modifying Machine of Third Embodiment

Figure 16:
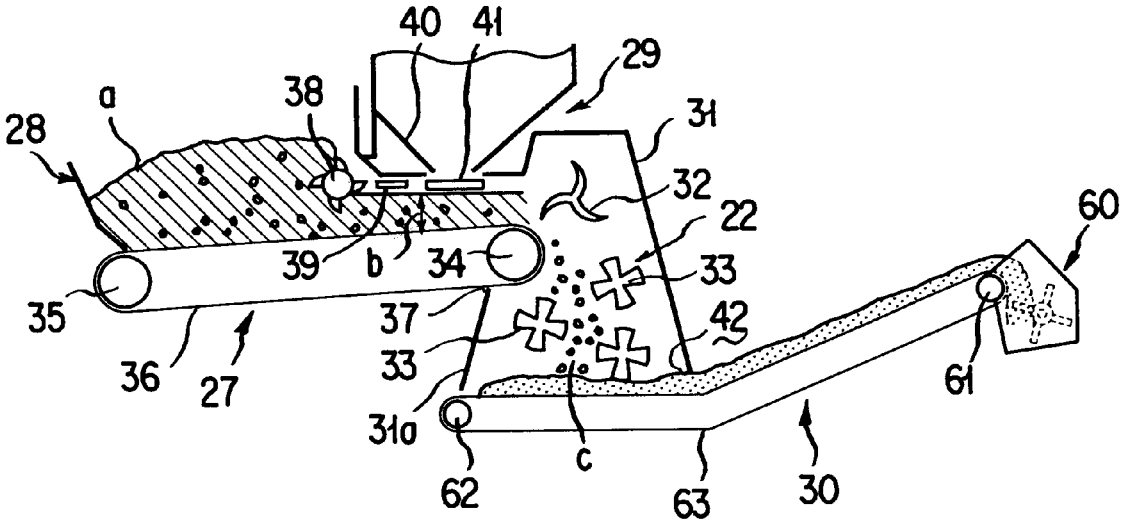
FIG. 16 is an illustration showing an essential structure of the soil modifying machine according to a third embodiment of the present invention.

A third embodiment of the soil modifying machine according to the present invention is generally shown in FIG. 16.

With reference to FIG. 16, the structures of the mixer 22, the soil conveyer 27, the soil hopper 28, the soil conditioner supply device 29 and the modified soil conveyer 30 have substantially the same as those of the conventional ones.

In this third embodiment, another mixer, which is called hereinlater as rear (or rear side) mixer 60 is arranged at a convey-out (discharge) portion of the modified soil conveyer 30 downstream side (i.e. rear side) of the former mixer 22. This rear mixer 60 acts to again crush and mix the modified soil which has been once crushed by the former mixer 22 and conveyed through the modified soil conveyer 30.

According to such an arrangement of the rear mixer 60, in a case where the soil crushed and modified by the mixer 22 still includes lumps having a large particle size, for example, in a mixing ratio of 20% of such large lumps, such large lumps can be effectively crushed and mixed by the rear mixer 60 so as to reduce the included large lumps, for example, in a mixing ratio of 5 to 10%. Accordingly, the infiltration of the soil conditioner into the material soil can be sufficiently improved, and the modified soil can be recycled and utilized as the backfill, roadbed material or like.

The specific structure of this rear (rear side) mixer 60 will be explained hereunder.

The modified soil conveyer 30 comprises, as shown in FIG. 16, a driving pulley 61, a driven pulley 62 and a belt wound around these pulleys in an endless manner.

Figure 17:
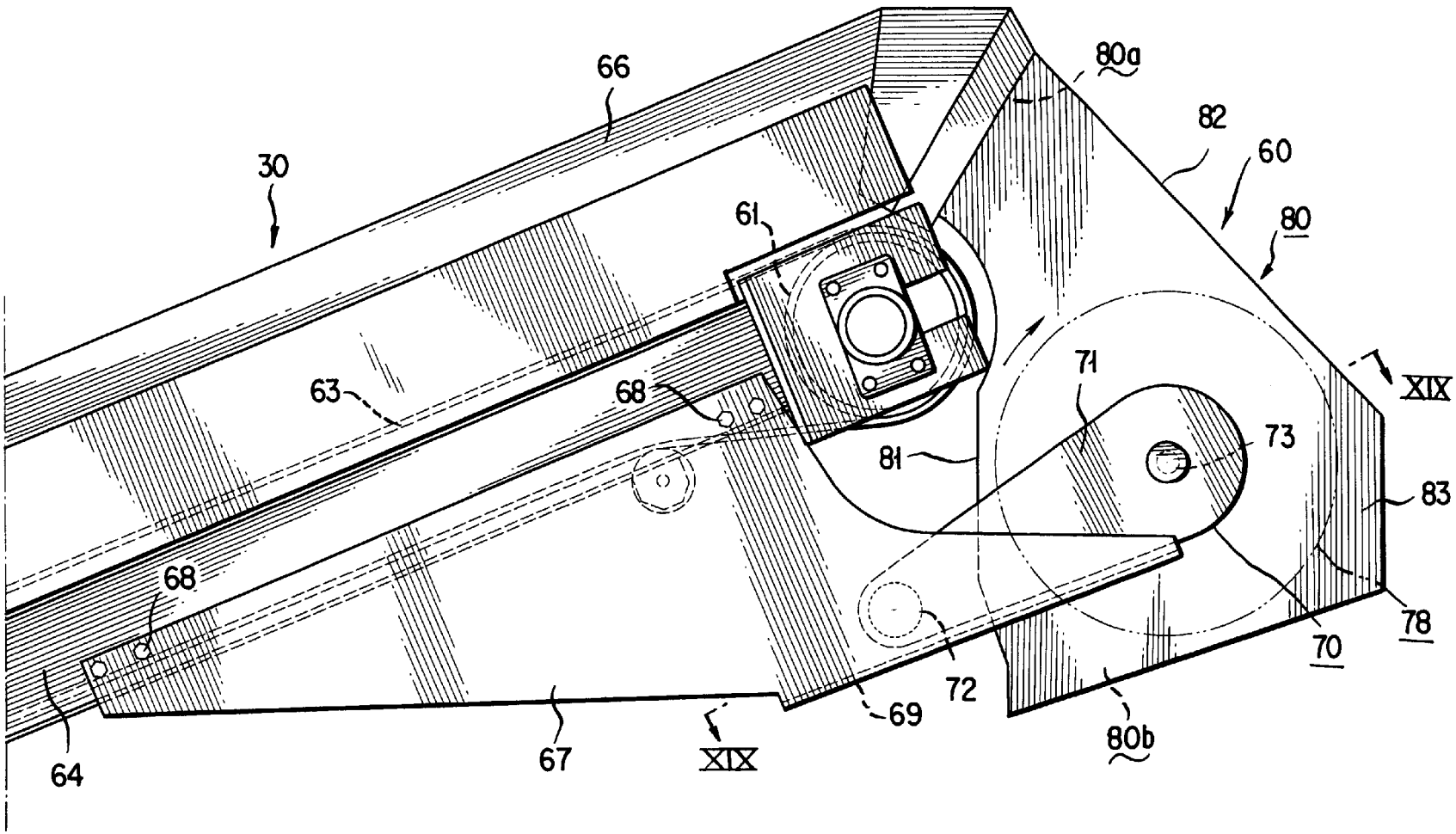
FIG. 17 is a side view showing a first example of a rear side mixer, in an enlarged scale, of the third embodiment of FIG. 16.
Figure 18:
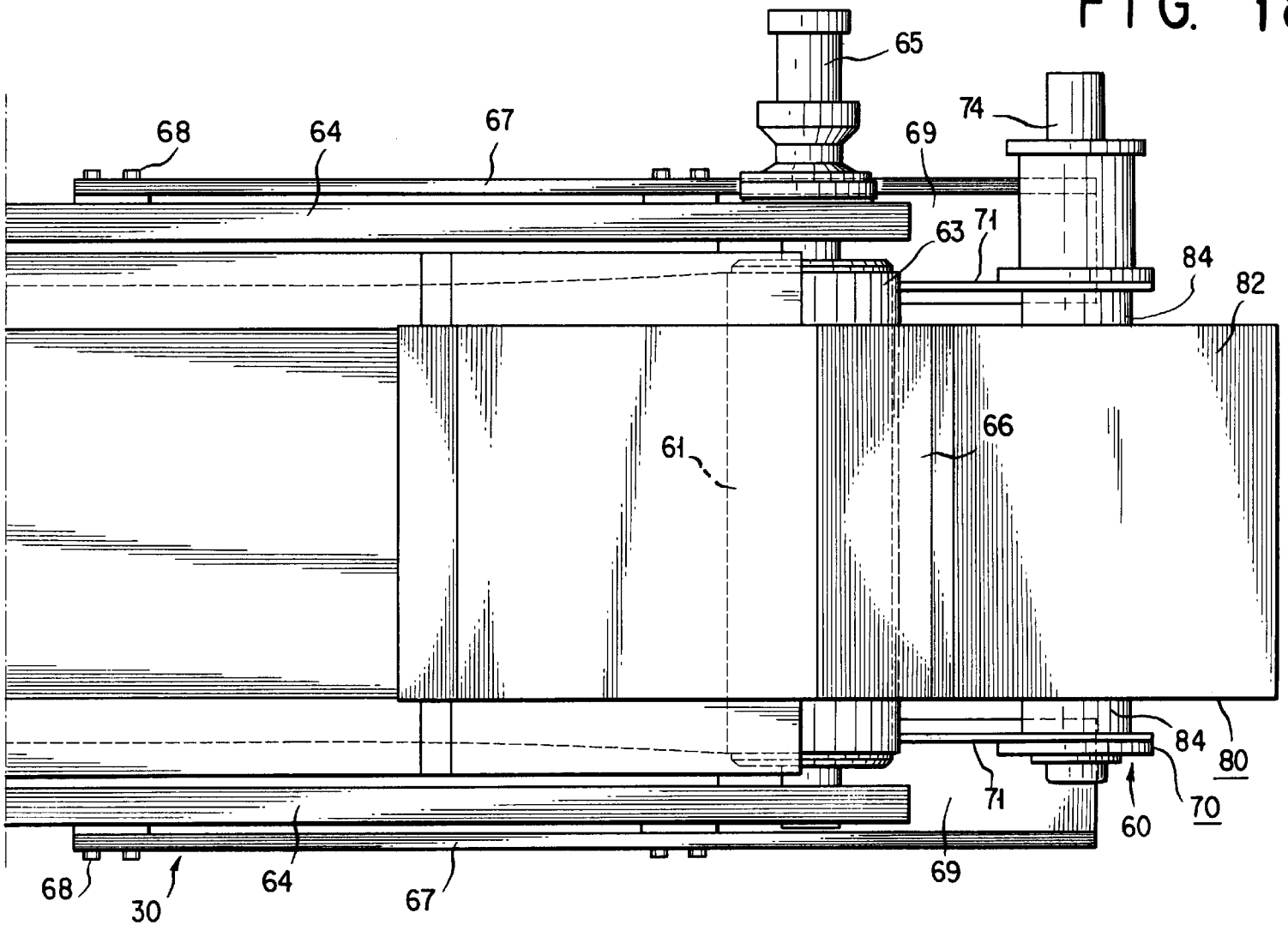
FIG. 18 is a plan view of FIG. 17.

With reference to FIGS. 17 and 18, the driving pulley 61 is mounted to be rotatable between one end portions of the longitudinal direction of a pair of conveyer frames 64, and this driving pulley 61 is driven and rotated by a motor 65 for driving the conveyer mounted to one side conveyer frame 64.

A conveyer cover 66 having approximately U-shaped in section is also mounted between the paired conveyer frames 64.

To the one end portions of the paired conveyer frames 64 mentioned above, there are mounted brackets 67, respectively, by means of bolts 68, to which the rear mixer 60 is mounted. The bracket 67 has a plate shape having a downward projection, as mount portion 69, extending downward over the driving pulley 61. The rear mixer 60 has a frame body 70 which is mounted to the mount portion 69 of the bracket 67.

The frame body 70 has a U-shaped plan view and is composed of a pair of long-scaled transverse members 71 and a connection member 72 mounted to one longitudinal end portions of both the transverse members 71 so as to cross the same. The paired transverse members 71 are secured to the mount portions 69 of the paired brackets 67 for the rear mixer 60, respectively.

Figure 19:
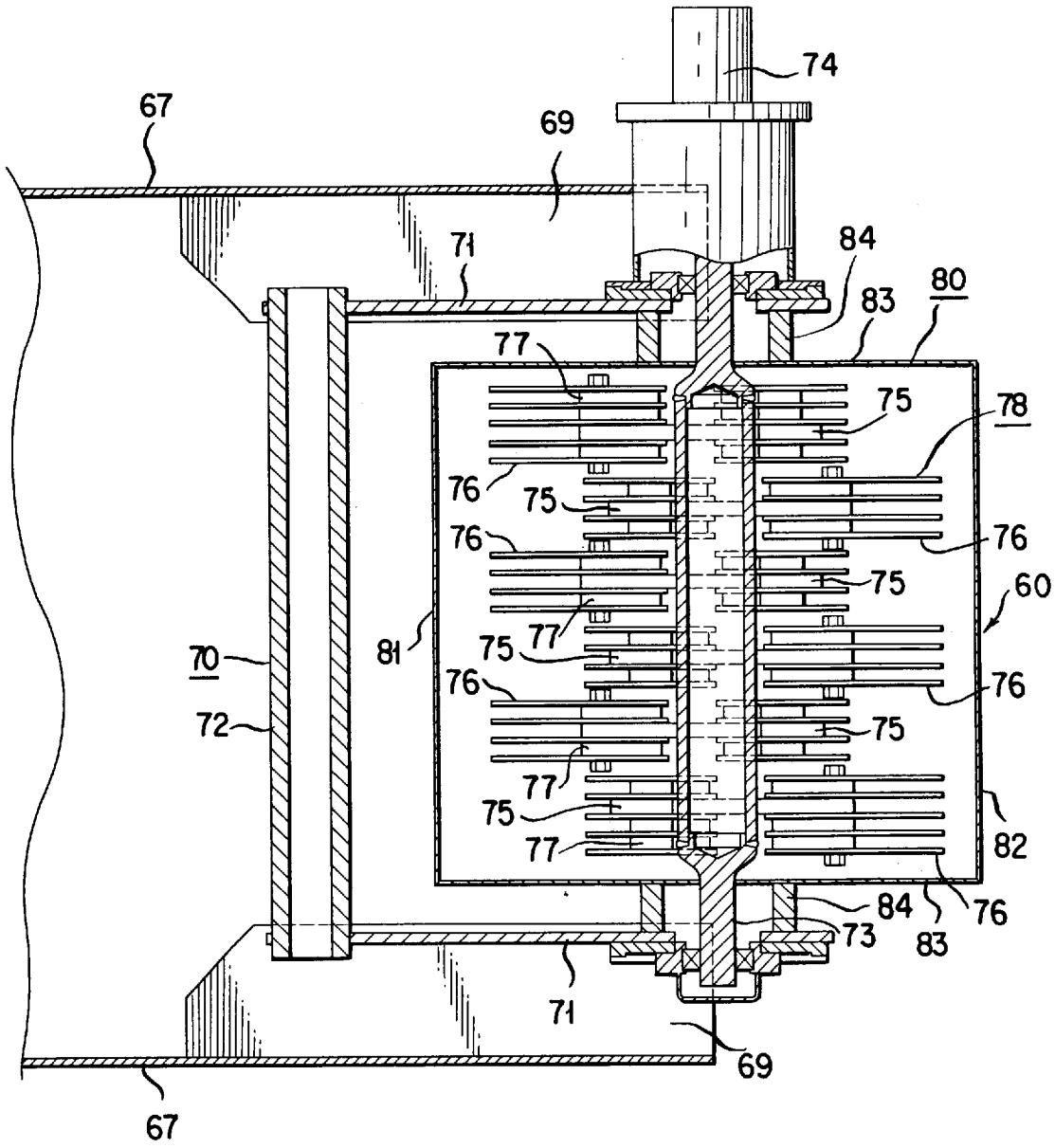
FIG. 19 is a sectional view taken along the line XIX—XIX of FIG. 17.

As shown in FIG. 19, a rotational shaft 73 crosses and is rotatably supported between the longitudinal other end portions of the paired transverse members 71 of the frame body 70. This rotational shaft 73 is driven and rotated by a motor 74 mounted to one of the transverse members 71.

Figure 20:
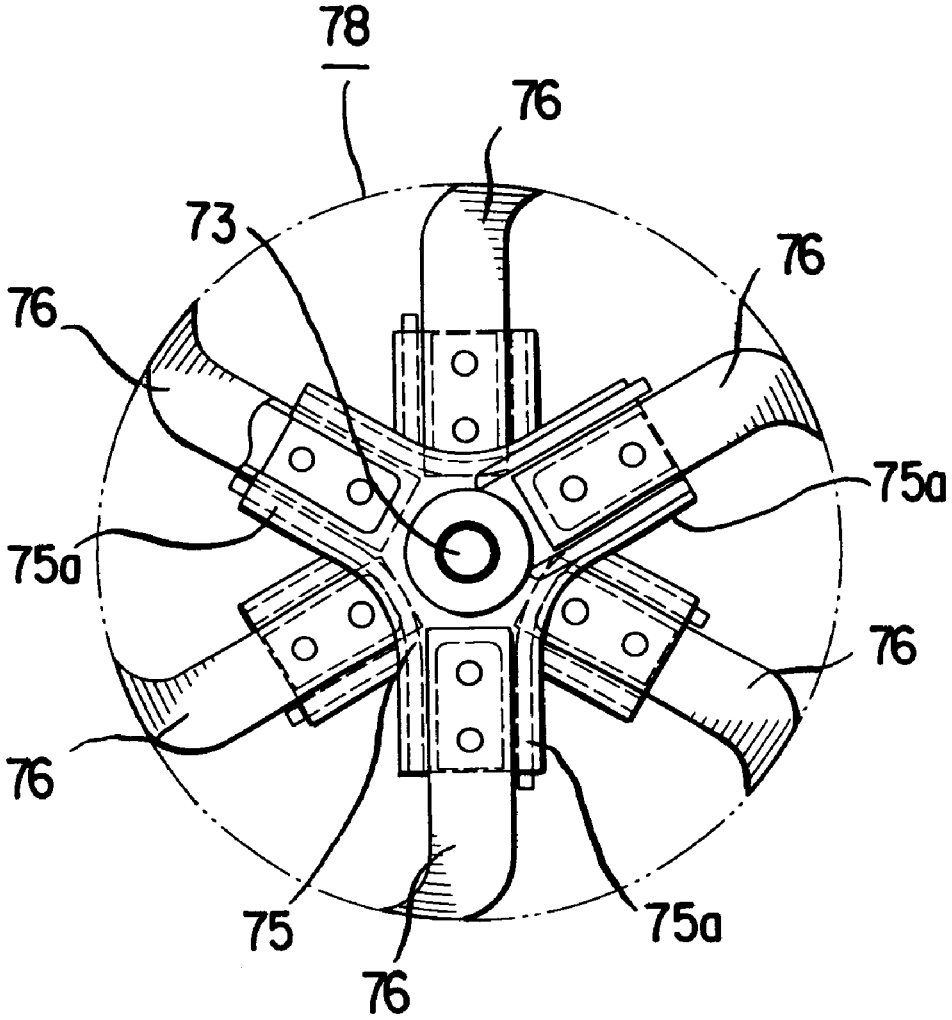
FIG. 20 is a side view of a rotary cutter device of the rear side mixer of the third embodiment.

Furthermore, as shown in FIGS. 19 and 20, a plurality of brackets 75 are fixed to the rotational shaft 73 with an axial interval from each other, and these brackets 75 are provided with a plurality of mount portions 75*a*, respectively so as to extend radially therefrom. A plurality of cutters 76 are mounted to the respective mount portions 75*a* of the brackets 75 through collars 77 with an axial interval from each other.

These cutters 76, brackets 75 and rotational shaft 73 constitute a rotary cutter device 78 in the manner that the plural cutters 76 are arranged so as to extend radially with an interval from each other, and the cutter 76 has a plate structure having a thickness of 4.5 mm and the adjacent cutters 76 are arranged with an interval (distance) of 22 mm therebetween.

A cover member 80 for covering the cutter device 78 is attached to the frame body 70. This cover member 80 comprises a front plate 81, a rear plate 82 and a pair of side plates 83 so as to provide a box-shaped structure having upper and lower openings, and the side plates 83 are secured to portions surrounding rotational shaft supporting portions of the paired transverse members 71 of the frame body 70 through ring-shaped spacers 84, respectively.

The upper opening 80*a* of the cover member 80 is connected to the conveyer cover member 66 and the lower opening 80*b* is opened downward.

According to the arrangement mentioned above, since the rotational shaft 73 (i.e. rotation center) of the rotary cutter device 78 is shifted, in position, apart from the driving pulley 61 (i.e. discharge portion of the modified soil conveyer 30) towards the downstream side in the conveying direction, the modified soil conveyed by the conveyer 63 falls on the driving pulley side 61 rater than the rotational shaft 73 of the cutter device 78.

The modified soil crushed and mixed by the mixer 22 is conveyed on the belt member 63 of the modified soil conveyer 30, then falls downward at the discharge portion thereof on the driving pulley 61 side rather than the rotational shaft 73 side of the cutter device 78 of the rear side mixer 60 and collides with the cutters 76 which are rotating in arrowed directions as shown in FIG. 17, whereby the modified soil can be further crushed and mixed.

In this operation, the lump of soil having a particle size smaller than the interval between the adjacent cutters 76 passes therebetween and falls therefrom.

As mentioned above, the modified soil colliding with the cutter 76 is sputtered by the rotation of the cutter 76 and collides with the rear plate 82 of the cover member 80, thus being again crushed and mixed. Furthermore, the modified soil once colliding with the rear plate 82 of the cover member 80 again collides with the cutter 76 and is crushed and mixed, and thereafter, the further crushed modified soil falls and is discharged through the lower opening 80*b* of the cover member 80.

The minimum interval (distance) between the rear plate 82 of the cover member 80 and the cutter 76 is set to a value of, for example, less than 20 mm, so that the lump of soil having a large particle diameter does not pass therebetween without colliding with the cutter 76.

As mentioned above, since the modified soil can be again crushed and mixed by the rear side mixer 60, the lump of the modified soil having a large particle diameter can be again crushed to thereby reduce the mixing ratio of the amount of the large lump of the modified soil in the soil crushed by the rear side mixer 60, whereby such modified soil can be effectively utilized as backfill, roadbed material or like.

Accordingly, even in a case where the modified soil which is obtained by crushing and mixing the soil to be modified and the soil conditioner by the mixer 22 includes much lump of soil having a large particle diameter size by the amount not recycled and usable as modified soil, the mixing ratio of such large particle sized lump of soil can be reduced by further crushing and mixing the once modified soil by the rear side mixer 60, such mixing ratio can be reduced, for example, to less than 5% of the included amount of lump of soil having a particle diameter of more than 20 mm. Such further modified soil can be recycled as backfill or roadbed material.

In the former embodiment, although the cutter device 78 of the rear mixer 60 is rotated by the motor 74, it may be driven and rotated by the conveyer motor 65 for the modified soil conveyer 60.

Figure 21:
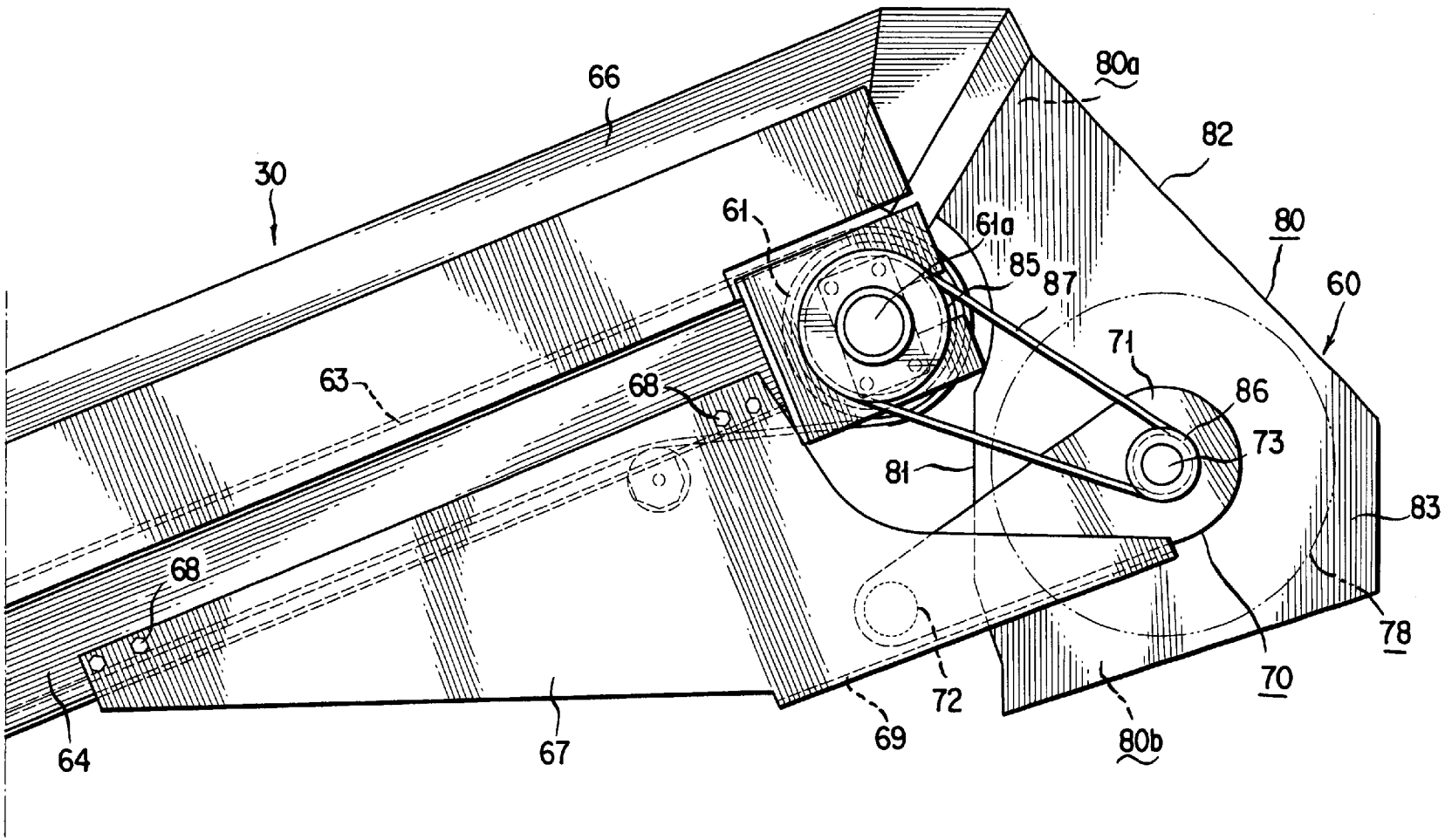
FIG. 21 is a side view showing a second example of a rear side mixer, in an enlarged scale, of the third embodiment of FIG. 16.
Figure 22:
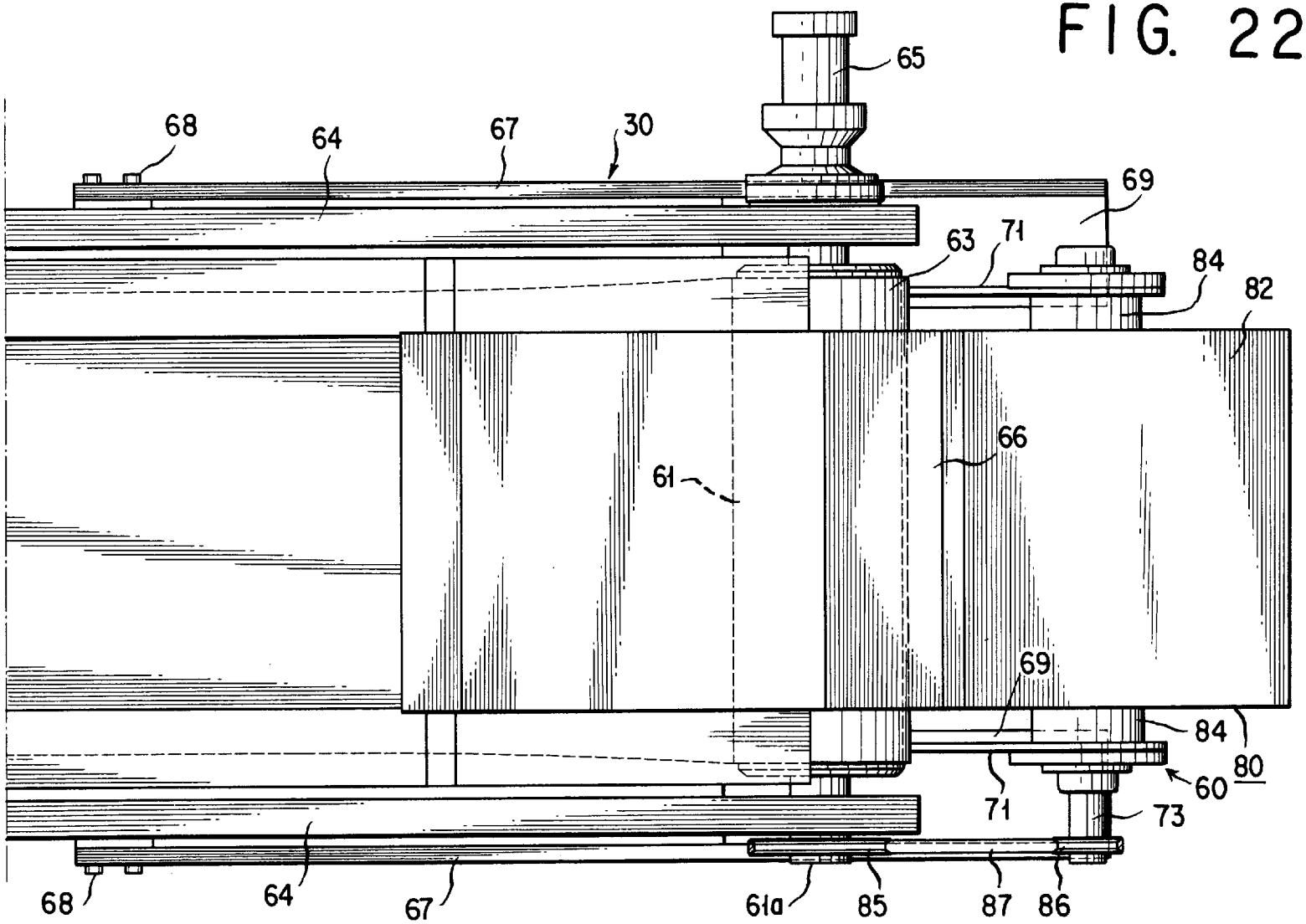
FIG. 22 is a plan view of FIG. 21.

For example, as shown in FIGS. 21 and 22, a pulley 85 is mounted to a shaft 61*a* of the driving pulley 61 and another pulley 86 is mounted to the rotational shaft 73 of the rotational cutter device 78. A belt is wound around these pulleys 85 and 86 and the cutter device 78 is rotated by the conveyer motor 65.

Further, in an alternation of this embodiment, the impact hammers 33 of the mixer 22 may be utilized in place of the rotational cutter device 78. Moreover, the rear side mixer 60 may merely have a structure with which the falling modified soil collides and is crushed.

Figure 23:
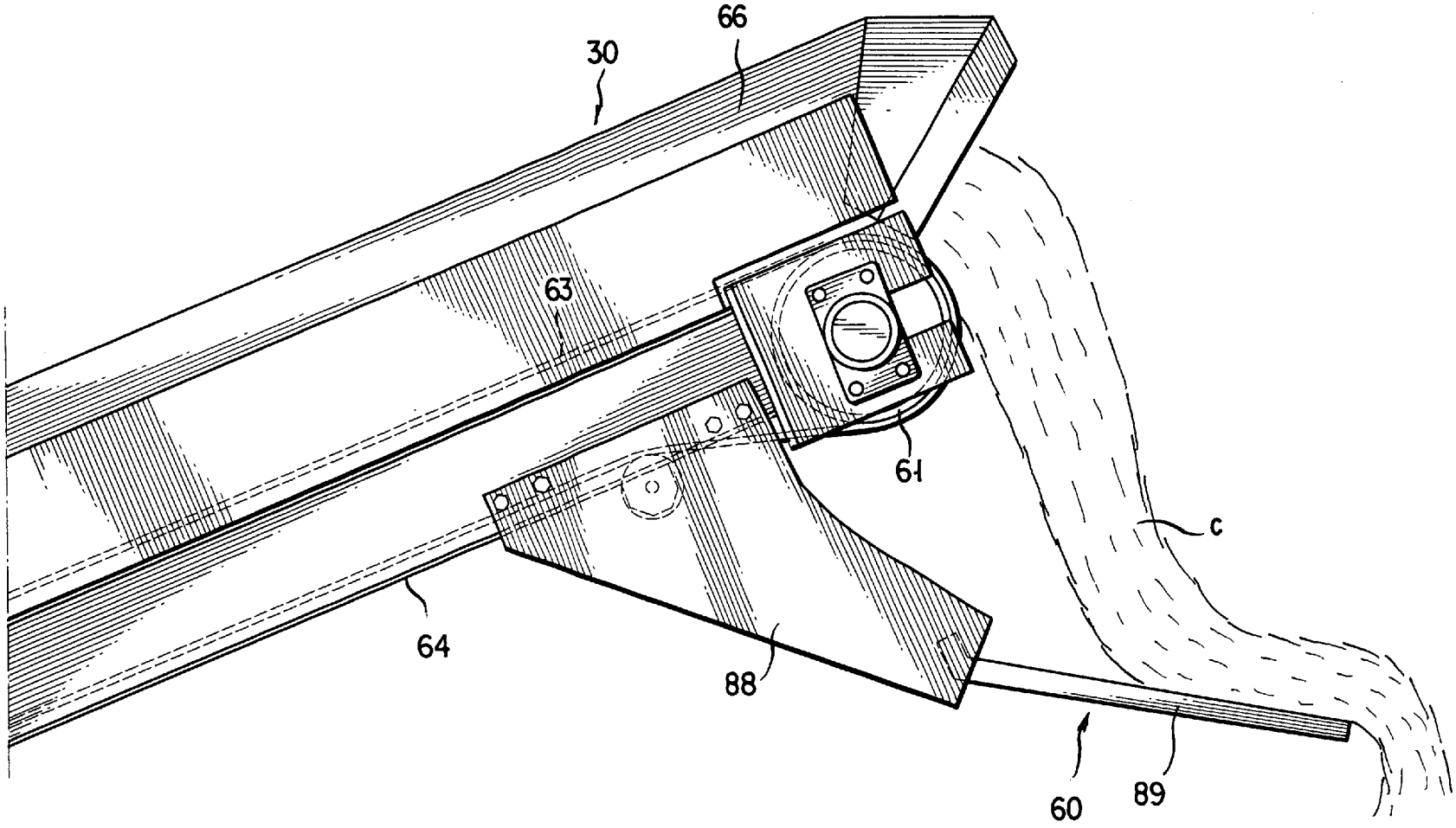
FIG. 23 is a side view showing a third example of a rear side mixer, in an enlarged scale, of the third embodiment of FIG. 16.

For example, as shown in FIG. 23, mounting brackets 88 are fixed to the conveyer frames 64 and a plate 89 is fixed to the mounting brackets 88 at an attitude inclined obliquely downward with respect to the horizontal attitude.

The modified soil c falling from the conveyer belt 63 collides with the plate 89 to be thereby crushed and mixed, and then, falls along the plate 89.

In such case, although the crushing and mixing ability is reduced in comparison with the case that the rear side mixer 60 provided with the cutter device 78 in the cover member 80 is used, it is possible to obtain the modified soil including lump of soil having a particle diameter of for example, more than 20 mm at a mixing ratio of about 10%.

Figure 24:
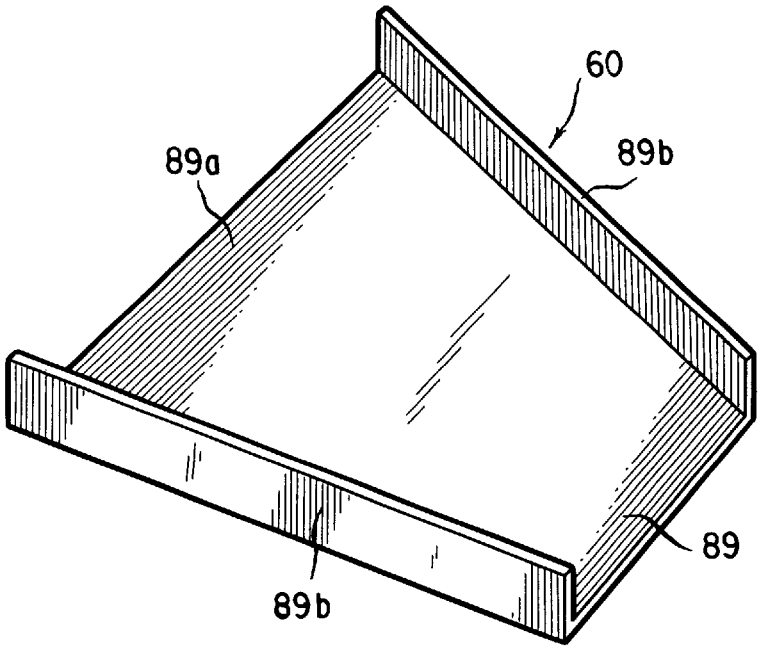
FIG. 24 is a perspective view of a plate shown in FIG. 23.

The plate 89 may take a structure, as shown in FIG. 24, that raised pieces 89*b* are formed to both side edges of a bottom plate 89*a*. According to this structure, the modified soil falling down and colliding with the plate 89 is not scattered therearound and can be moved downward along the bottom plate 89*a*.

Further, in the structure of the embodiment mentioned above, although the rear side mixer 60 is secured to the modified soil conveyer 30, it may be disposed separately therefrom.

Figure 25:
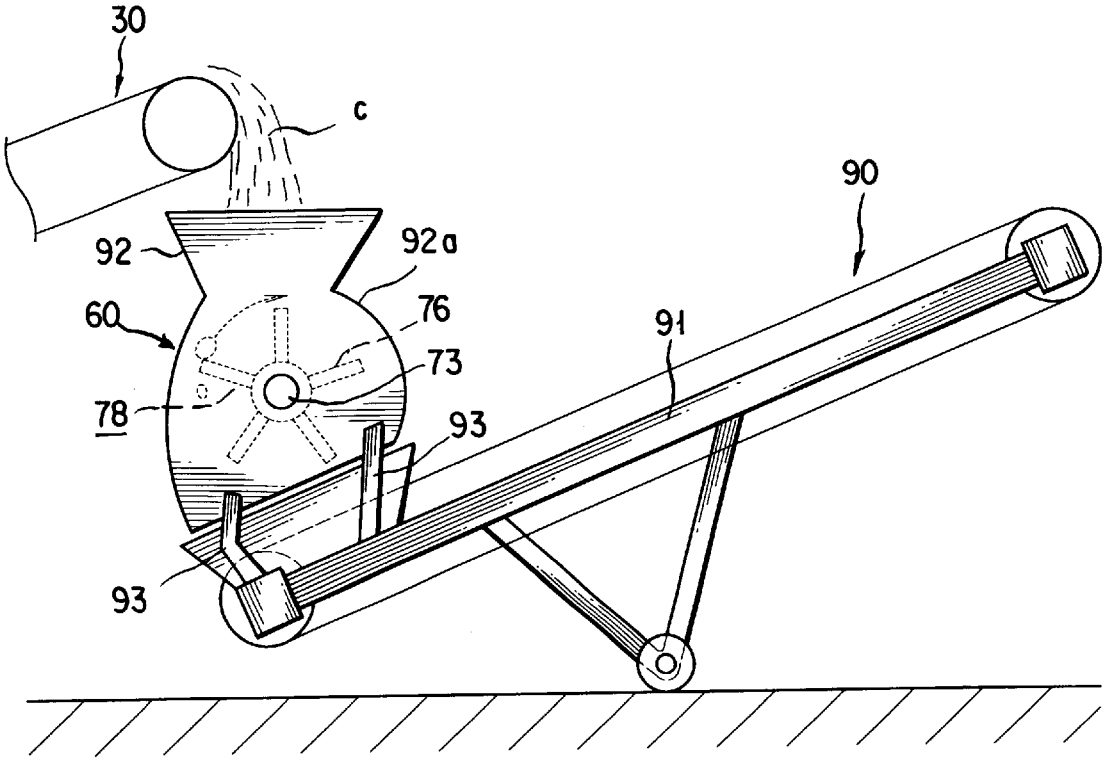
FIG. 25 is a side view showing a fourth example of a rear side mixer, in an enlarged scale, of the third embodiment of FIG. 16.

For example, as shown in FIG. 25, the rear side mixer 60 may be composed of a secondary belt conveyer 90 disposed downstream side of the modified soil conveyer 30, a housing 92 is mounted, through a bracket 93, to a conveyer frame 91 of the secondary conveyer 90, and the rotational cutter device 78 of the structure mentioned above is disposed inside the housing 92.

According to such a structure, the modified soil c conveyed by the modified soil conveyer 30 falls inside the housing 92 and collides with the cutter 76 arranged at a portion near the conveyer 30 rather than the rotational shaft 73. The modified soil sputtered by the cutter 76 collides with a rear wall section 92*a* of the housing 92 and again collides with the cutter 76. Thereafter, the crushed modified soil is discharged.

Figure 26:
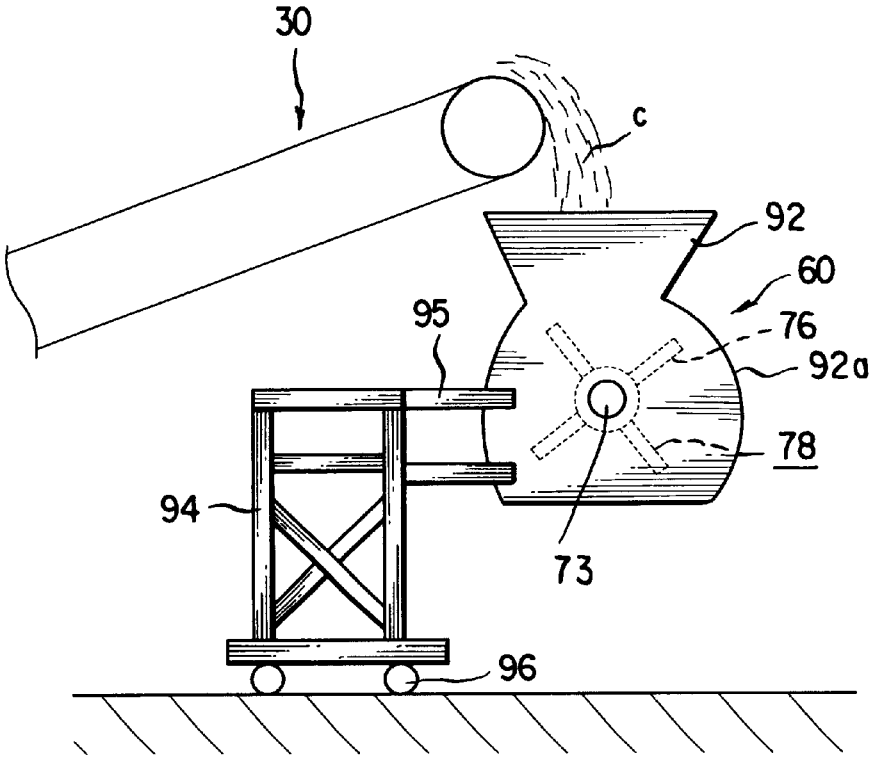
FIG. 26 is a side view showing a fifth example of a rear side mixer, in an enlarged scale, of the third embodiment of FIG. 16.

Furthermore, as shown in FIG. 26, the housing 92 may be attached to a frame structure 94 through a bracket 95, and the frame structure 94 may be made movable by attaching wheels 96 thereto. According to such structure, the rear mixer 60 can be easily moved to a portion lower than the discharge portion of the modified soil conveyer 30 to again crush and mix the once modified soil c discharged through the conveyer 30.

Still furthermore, with reference to FIGS. 25 and 26, the rear side mixer 60 is disposed below the discharge portion of the modified soil conveyer 30, a further conveyer means may be disposed downstream side of the modified soil conveyer 30 and the rear mixer 60 is located to a discharge portion of this further disposed conveyer. In such arrangement, substantially the same function as that in the case of FIGS. 25 and 26 will be attained.

The rear side mixer 60 may have a structure in which impact hammers 33 of the mixer 22 in the former embodiment are disposed inside the housing 92 in place of the cutter device 78.

Structure of Soil Modifying Machine of Fourth Embodiment

Figure 27:
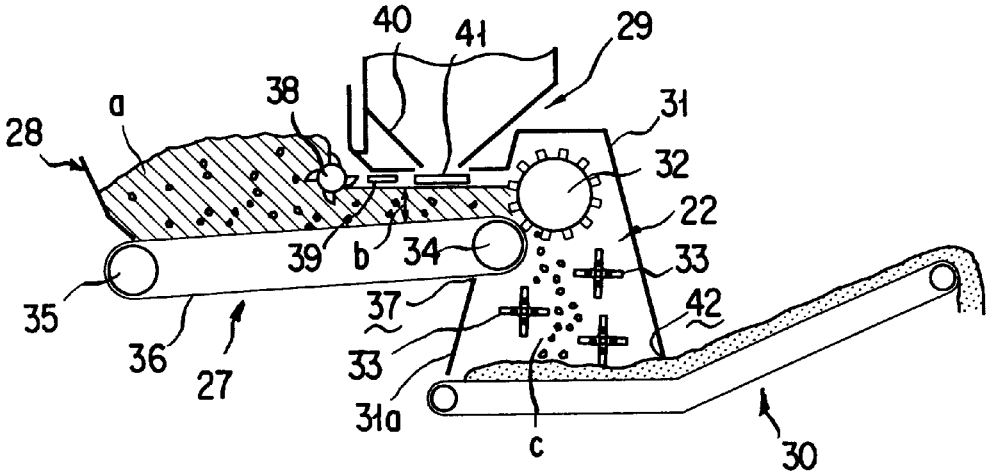
FIG. 27 is an illustration showing an essential structure of the soil modifying machine according to a fourth embodiment of the present invention.

A fourth embodiment of the soil modifying machine according to the present invention is generally shown in FIG. 27, in which the soil cutter device 32 of the mixer 22 is made as drum-type soil cutter device as mentioned hereinbefore and the impact hammer 33 is made as the plate-type impact hammer 33 also as mentioned hereinbefore.

According to the structure of this embodiment, since the soil to be modified and the soil conditioner can be sufficiently crushed and mixed in the mixer 22, the mixing ratio of the large sized soil particles (having a diameter of more than 20 mm) in the modified soil c is less than 5%. Accordingly, the thus obtained modified soil can be adequately recycled as backfill or roadbed material.

Structure of Soil Modifying Machine of Fifth Embodiment

Figure 28:
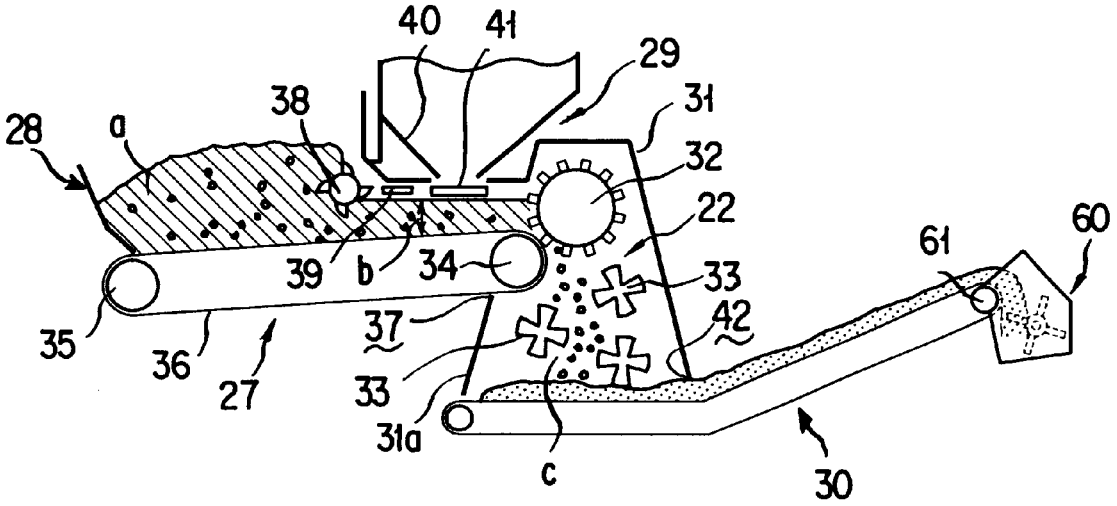
FIG. 28 is an illustration showing an essential structure of the soil modifying machine according to a fifth embodiment of the present invention.

A fifth embodiment of the soil modifying machine according to the present invention is generally shown in FIG. 28, in which the soil cutter device of the mixer 22 is made as drum-type soil cutter device and the rear side mixer 60 is arranged to the discharge portion of the modified soil conveyer 30.

According to the structure of this embodiment, the mixing ratio of the large sized soil particles (having a diameter of more than 20 mm) in the modified soil c discharged from the rear side mixer 60 is less than 5%. Accordingly, the thus obtained modified soil can be adequately recycled as backfill or roadbed material.

Structure of Soil Modifying Machine of Sixth Embodiment

Figure 29:
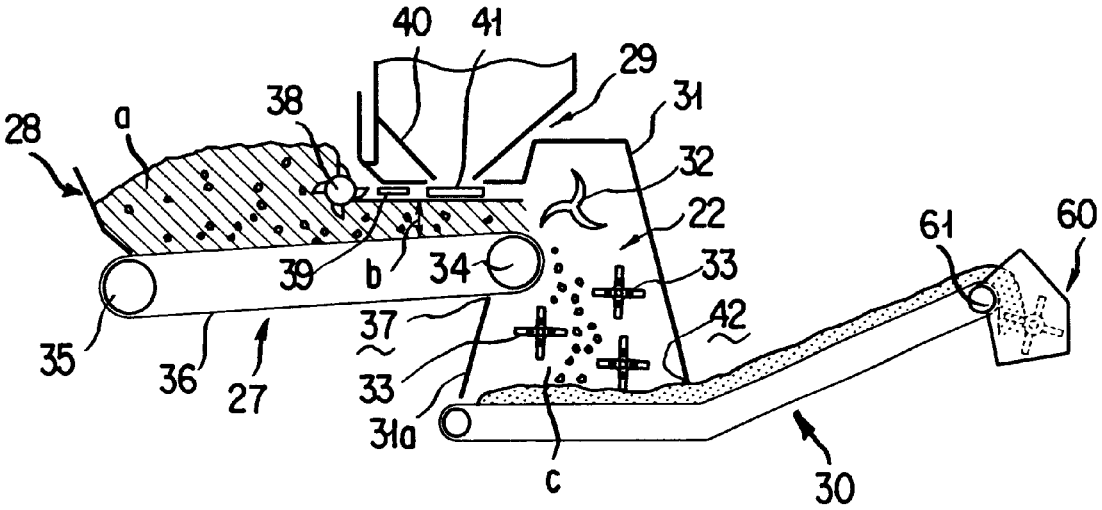
FIG. 29 is an illustration showing an essential structure of the soil modifying machine according to a sixth embodiment of the present invention.

A sixth embodiment of the soil modifying machine according to the present invention is generally shown in FIG. 29, in which the impact hammer 33 of the mixer 22 is made as plate-type hammer 33 and the rear side mixer 60 is arranged to the discharge portion of the modified soil conveyer 30.

According to the structure of this embodiment, the mixing ratio of the large sized soil particles (having a diameter of more than 20 mm) in the modified soil c discharged from the rear side mixer 60 is less than 5%. Accordingly, the thus obtained modified soil can be adequately recycled as backfill or roadbed material.

Structure of Soil Modifying Machine of Seventh Embodiment

Figure 30:
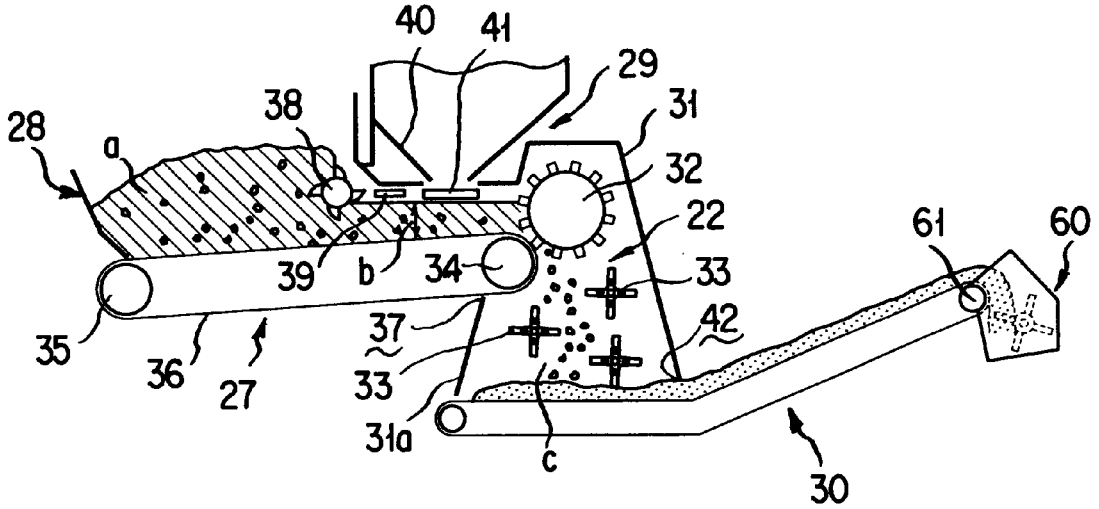
FIG. 30 is an illustration showing an essential structure of the soil modifying machine according to a seventh embodiment of the present invention.

A seventh embodiment of the soil modifying machine according to the present invention is generally shown in FIG. 30, in which the soil cutter device 32 of the mixer 22 is made as drum-type soil cutter device 32,the impact hammer 33 is made as the plate-type impact hammer 33 and the rear side mixer 60 is arranged to the discharge portion of the modified soil conveyer 30.

According to the structure of this embodiment, the large sized soil particles (having a diameter of more than 20 mm) less remains in the modified soil c discharged from the rear side mixer 60. Accordingly, the thus obtained modified soil can be adequately recycled as backfill or roadbed material.

Structure of Soil Modifying Machine of Eighth Embodiment

Figure 31:
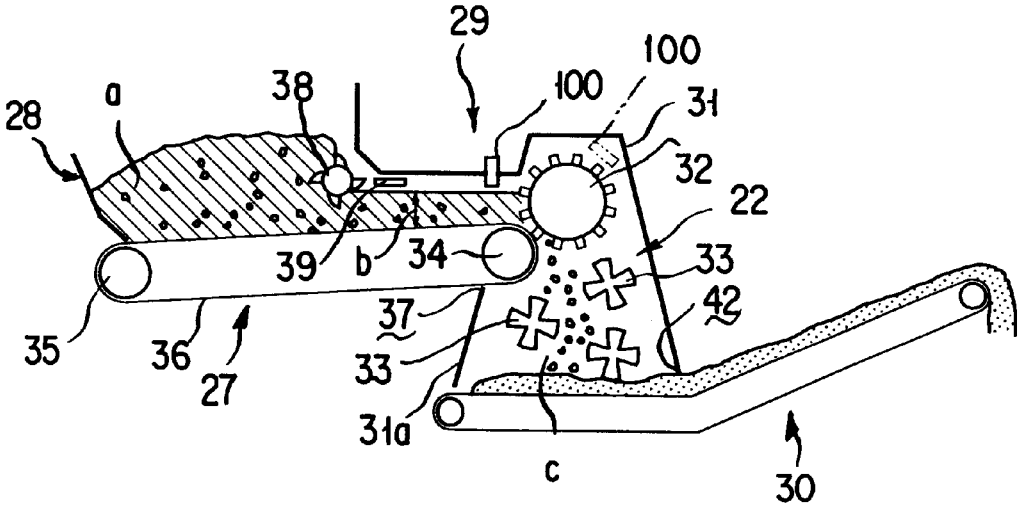
FIG. 31 is an illustration showing an essential structure of the soil modifying machine provided with another example of a soil conditioner supply device.

An eighth embodiment of the soil modifying machine according to the present,invention is generally shown in FIG. 31, in which the soil conditioner supply device 29 is composed of a nozzle 100 arranged near a charging port 37 of the mixer 22 and a liquid soil conditioner is jetted to the soil to be modified on the conveyer 27 through the nozzle 100. Such nozzle 100 may be disposed inside the case 31 of the mixer 22 as shown with a virtual line.

Such arrangement of the soil conditioner supply device 29 may be applied to the respective embodiments mentioned hereinbefore.

Structure of Soil Modifying Machine of Ninth Embodiment

Figure 32:
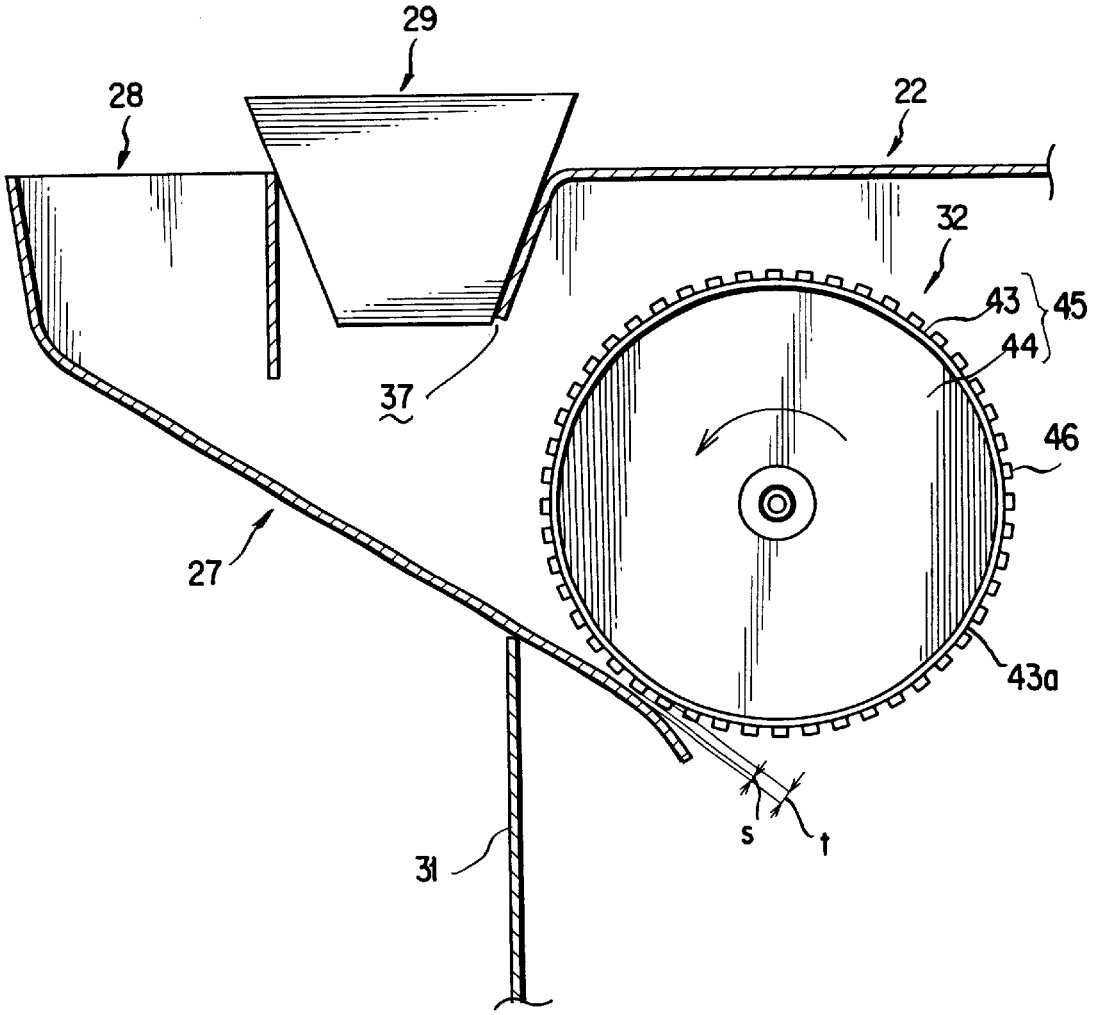
FIG. 32 is a sectional view of a mixer and a material soil conveyer of another example.
Figure 33:
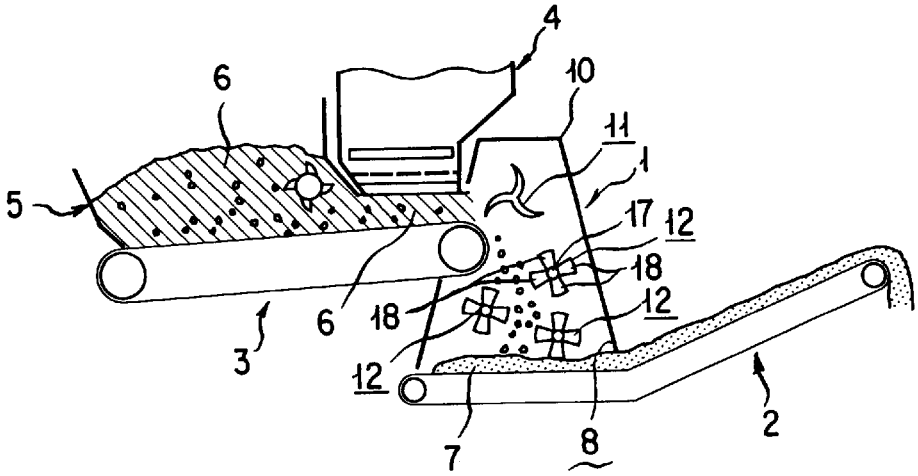
FIG. 33 is an illustration showing an essential structure of the soil modifying machine having a conventional structure.
Figure 34A:
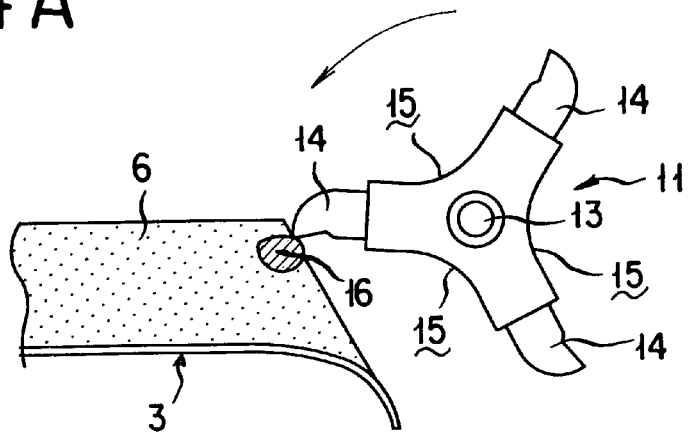
FIGS. 34A to 34D include views explaining an operation of a soil cutter device of a conventional structure.
Figure 34B:
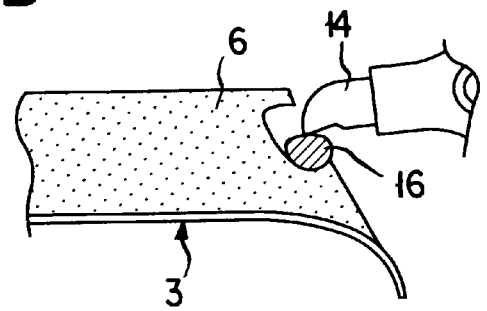
Figure 34C:
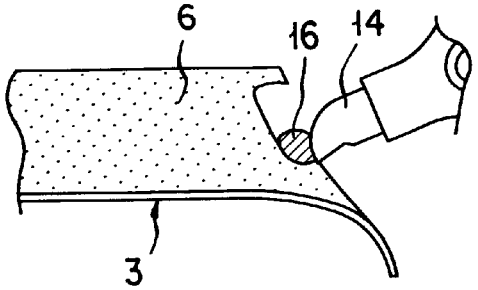
Figure 34D:
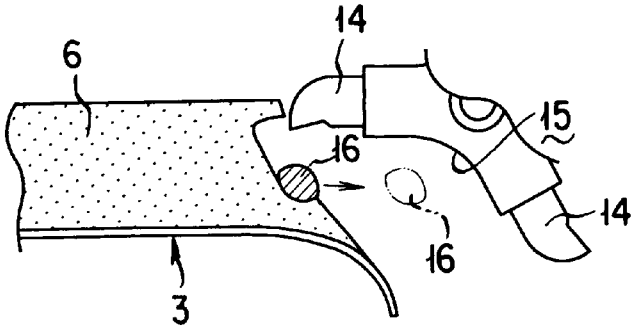

A ninth embodiment of the soil modifying machine according to the present invention is partially shown in FIG. 32, in which the soil conveyer 27 is formed of a plate member so that the soil slides downward along the plate member by its self-gravity.

Such soil conveyer 27 may be applied to the respective first to seventh embodiments mentioned hereinbefore.

It is to be noted that the present invention concerning the soil modifying machine is not limited to the described embodiments and many other changes, modifications and organic combinations may be made without departing from the scopes of the appended claims.

What is claimed is:

1. A soil modifying machine comprising:

a machine body;

a hopper through which a soil to be modified is fed to the machine body;

a soil conveying means for conveying the soil supplied through the hopper;

a soil conditioner supply device for supplying a soil conditioner to the soil;

a mixing unit disposed at a discharge portion of the soil conveying means, said mixing unit comprising an outer case, a soil cutter device disposed inside the case and a plurality of impact hammers disposed below the soil cutter device, said soil cutter device comprising a cylindrical drum, a plurality of cutters mounted to an outer peripheral surface of the drum, and a driving means for driving and rotating the drum; and a modified soil conveyor disposed at a discharge portion of said mixer unit;

wherein each of said cutters has a portion projecting from the outer peripheral surface of the drum by a length substantially equal to or less than a target particle diameter of the soil to be modified and a minimum distance between the outer peripheral surface of the drum and a conveying surface of the soil conveying means is substantially equal to said target particle diameter.

2. A soil modifying machine comprising:

a machine body;

a hopper through which a soil to be modified is fed to the machine body;

a soil conveying means for conveying the soil supplied through the hopper;

a soil conditioner supply device for supplying a soil conditioner to the soil;

a first mixing unit disposed at a discharge portion of the soil conveying means, said mixing unit comprising an outer case, a soil cutter device disposed inside the case and a plurality of impact hammers disposed below the soil cutter device;

a modified soil conveyer disposed at a discharge portion of said first mixer unit; and a second mixer unit disposed downstream side of the modified soil conveyer conveying the soil modified in the first mixer unit for further crushing and mixing the once modified soil;

wherein said second mixer unit is disposed at a discharge portion of the modified soil conveyer.

3. A soil modifying machine comprising:

a machine body;

a hopper through which a soil to be modified is fed to the machine body;

a soil conveying means for conveying the soil supplied through the hopper;

a soil conditioner supply device for supplying a soil conditioner to the soil;

a first mixing unit disposed at a discharge portion of the soil conveying means, said mixing unit comprising an outer case, a soil cutter device disposed inside the case and a plurality of impact hammers disposed below the soil cutter device;

a modified soil conveyer disposed at a discharge portion of said first mixer unit; and a second mixer unit disposed downstream side of the modified soil conveyer conveying the soil modified in the first mixer unit for further crushing and mixing the once modified soil;

wherein said second mixer is disposed independently of the machine body and disposed so as to oppose to a discharge portion of the modified soil conveyer.

* * * * *